US009171503B2

(12) United States Patent
Kim et al.

(10) Patent No.: US 9,171,503 B2
(45) Date of Patent: Oct. 27, 2015

(54) ORGANIC LIGHT EMITTING DISPLAY, METHOD FOR DRIVING THE SAME, AND METHOD FOR MANUFACTURING THE SAME

(71) Applicant: LG DISPLAY CO., LTD., Seoul (KR)

(72) Inventors: Jihun Kim, Paju-si (KR); Sangho Yu, Paju-si (KR); Woojin Nam, Goyang-si (KR); Joongsun Yoon, Paju-si (KR); Minkyu Chang, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 23 days.

(21) Appl. No.: 14/095,773

(22) Filed: Dec. 3, 2013

(65) Prior Publication Data

US 2014/0184481 A1 Jul. 3, 2014

(30) Foreign Application Priority Data

Dec. 27, 2012 (KR) ..... 10-2012-0155145

(51) Int. Cl.
*G09G 3/30* (2006.01)
*G09G 3/32* (2006.01)

(52) U.S. Cl.
CPC ..... *G09G 3/3233* (2013.01); *G09G 2300/0852* (2013.01); *G09G 2300/0861* (2013.01); *G09G 2320/045* (2013.01)

(58) Field of Classification Search
CPC .. G09G 3/3208; G09G 3/3266; G09G 3/3291
See application file for complete search history.

(56) References Cited

U.S. PATENT DOCUMENTS

2011/0157143 A1* 6/2011 Choi et al. ..... 345/212
2014/0084792 A1* 3/2014 Oh et al. ..... 315/120

* cited by examiner

*Primary Examiner* — Joseph Haley
*Assistant Examiner* — Ifedayo Iluyomade
(74) *Attorney, Agent, or Firm* — Birch, Stewart, Kolasch & Birch, LLP

(57) ABSTRACT

An organic light emitting display, a method for driving the same, and a method for manufacturing the same are discussed. The organic light emitting display according to an embodiment includes a panel including subpixels each having a compensation circuit including a reference voltage supply transistor, which receives a reference voltage and initializes a node of a gate electrode of a driving transistor using the reference voltage, a scan driver supplying a scan signal to scan lines of the panel, a data driver supplying a data signal to data lines of the panel, a timing controller controlling the scan driver and the data driver, and a reference voltage compensation unit which varies the reference voltage on each scan line and supplies the reference voltage to the subpixels.

10 Claims, 28 Drawing Sheets

ORGANIC LIGHT EMITTING DISPLAY, METHOD FOR DRIVING THE SAME, AND METHOD FOR MANUFACTURING THE SAME

This application claims the benefit of Korean Patent Application No. 10-2012-0155145 filed on Dec. 27, 2012, the entire contents of which is incorporated herein by reference for all purposes as if fully set forth herein.

BACKGROUND OF THE INVENTION

1. Field of the Invention

Embodiments of the invention relate to an organic light emitting display, a method for driving the same, and a method for manufacturing the same.

2. Description of the Related Art

An organic light emitting element used for an organic light emitting display is a self-emission element in which a light emitting layer is formed between two electrodes disposed on a substrate. The organic light emitting display may be classified into a top emission type, a bottom emission type, and a dual emission type depending on a light emission direction. The organic light emitting display may be classified into a passive matrix type and an active matrix type depending on a driving method.

The organic light emitting display includes a panel including subpixels emitting light, a scan driver supplying a scan signal to the panel, and a data driver supplying a data signal to the panel. Each subpixel includes an organic light emitting diode emitting light, a driving transistor supplying a driving current, etc.

The characteristics of a threshold voltage of the driving transistor change by various causes and reasons. Thus, each subpixel includes a compensation circuit for compensating for changes in the characteristics of the threshold voltage. However, the related art organic light emitting display requires a study to efficiently reduce various side effects, which may be caused due to the use of the compensation circuit included in the subpixel. Thus, the related art organic light emitting display has to find a method capable of efficiently reducing the side effects caused due to the use of the compensation circuit.

SUMMARY OF THE INVENTION

In one aspect, there is an organic light emitting display comprising a panel including subpixels each having a compensation circuit including a reference voltage supply transistor, which receives a reference voltage and initializes a node of a gate electrode or a drain electrode of a driving transistor using the reference voltage, a scan driver configured to supply a scan signal to scan lines of the panel, a data driver configured to supply a data signal to data lines of the panel, a timing controller configured to control the scan driver and the data driver, and a reference voltage compensation unit configured to vary the reference voltage on each scan line and supply the reference voltage to the subpixels.

In another aspect, there is a method for driving an organic light emitting display comprising supplying a reference voltage to subpixels included in a panel, supplying a scan signal to the subpixels included in the panel, and supplying a data signal to the subpixels included in the panel, wherein the supplying of the reference voltage includes varying the reference voltage on each scan line of the panel.

In another aspect, there is an organic light emitting display comprising a panel including subpixels each having a compensation circuit including a reference voltage supply transistor, which receives a reference voltage and initializes a node of a gate electrode or a drain electrode of a driving transistor using the reference voltage, a scan driver configured to supply a scan signal to scan lines of the panel, a data driver configured to supply a scan signal to data lines of the panel, a timing controller configured to control the scan driver and the data driver, and a reference voltage compensation unit configured to supply the reference voltage including a reverse voltage opposite a ripple generated in the reference voltage to the subpixels and cancel the ripple.

In another aspect, there is a method for driving an organic light emitting display comprising measuring a panel and dating a gain value for cancelling a ripple generated in a reference voltage, supplying the reference voltage including a reverse voltage opposite the ripple generated in the reference voltage using the gain value to subpixels included in the panel to cancel the ripple, supplying a scan signal to the subpixels included in the panel, and supplying a data signal to the subpixels included in the panel.

In another aspect, there is a method for manufacturing an organic light emitting display comprising forming panels including subpixels each having a compensation circuit including a reference voltage supply transistor, which supplies a reference voltage to a node of a driving transistor, setting the reference voltage in each panel and driving the panels, measuring display characteristics of each panel, and differently modifying the reference voltages of the panels based on the measured display characteristics of each panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments of the invention will be described below with reference to FIGS. 1 to 34.

First Embodiment

Figure 1:
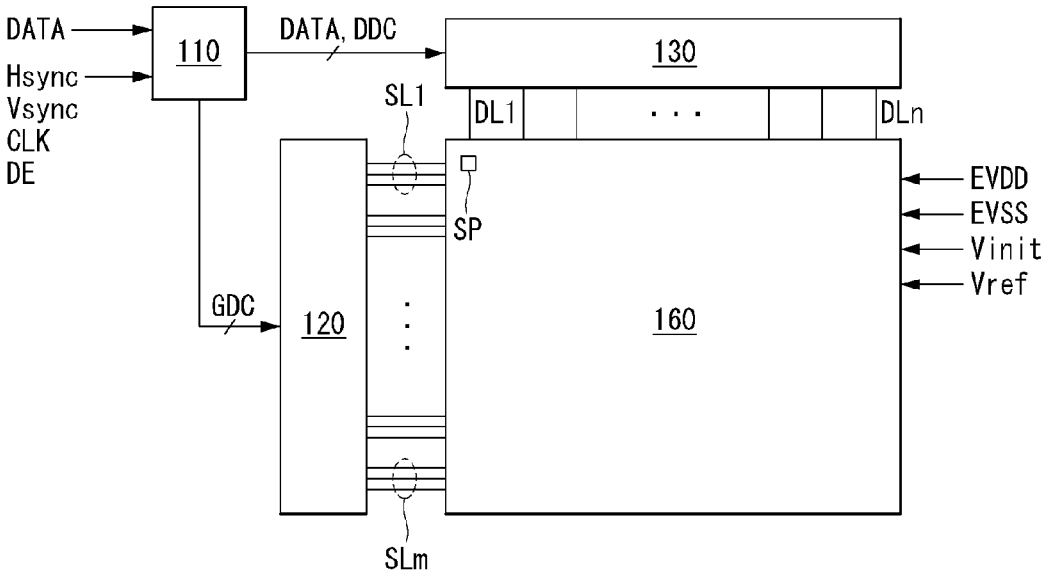
FIG. 1 schematically shows a configuration of an organic light emitting display according to a first embodiment of the invention.
Figure 2:
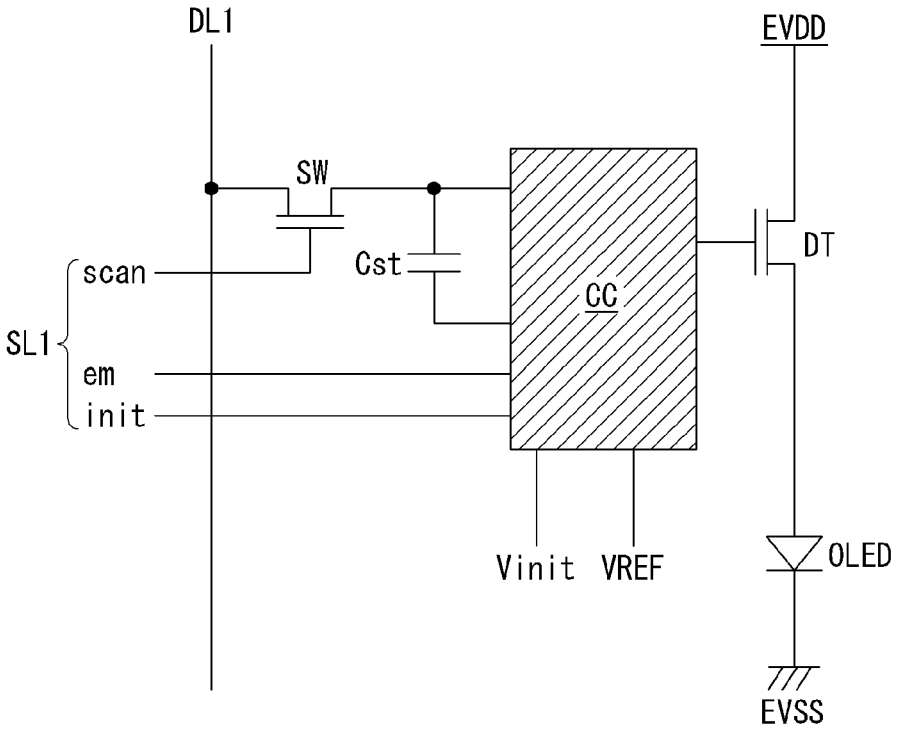
FIG. 2 shows a circuit configuration of a subpixel.

FIG. 1 schematically shows a configuration of an organic light emitting display according to a first embodiment of the invention. FIG. 2 shows a circuit configuration of a subpixel.

As shown in FIG. 1, the organic light emitting display according to the first embodiment of the invention includes a timing controller 110, a data driver 130, a scan driver 120, and a panel 160.

The timing controller 110 controls operation timings of the data driver 130 and the scan driver 120 using timing signals, such as a vertical sync signal Vsync, a horizontal sync signal Hsync, a data enable signal DE, and a clock CLK, received from the outside. The timing controller 110 may determine a frame period by counting the data enable signal DE of one horizontal period, and thus the vertical sync signal Vsync and the horizontal sync signal Hsync received from the outside may be omitted. Control signals generated by the timing controller 110 includes a gate timing control signal GDC for controlling the operation timing of the scan driver 120 and a data timing control signal DDC for controlling the operation timing of the data driver 130.

The scan driver 120 sequentially generates scan signals while shifting a level of a gate driving voltage in response to the gate timing control signal GDC received from the timing controller 110. The scan driver 120 supplies the scan signals through scan lines SL1 to SLm connected to subpixels SP included in the panel 160.

The data driver 130 samples and latches a data signal DATA supplied from the timing controller 110 in response to the data timing control signal DDC received from the timing controller 110 and converts the latched signal into data of a parallel data system. The data driver 130 converts the data signal DATA into a gamma reference voltage. The data driver 130 supplies the data signal DATA through data lines DL1 to DLn connected to the subpixels SP included in the panel 160.

The panel 160 includes the subpixels SP arranged in a matrix form. The subpixels SP include red subpixels, green subpixels, and blue subpixels. The subpixels SP may include white subpixels, if necessary or desired. In the panel 160 including the white subpixels, a light emitting layer of each subpixel SP may emit not red, green, and blue light but white light. In this instance, the white light is converted into red, green, and blue light using red, green, and blue color filters.

Each of the subpixels SP included in the panel 160 may be configured, for example, as shown in FIG. 2. Each subpixel includes a switching transistor SW, a driving transistor DT, a storage capacitor Cst, a compensation circuit CC, and an organic light emitting diode OLED.

The switching transistor SW is turned on or off in response to the scan signal supplied through the first scan line SL1, so that the data signal supplied through the first data line DL1 is stored in the storage capacitor Cst as a data voltage. The driving transistor DT operates, so that a driving current flows between a first power supply line EVDD and a first ground line EVSS in response to the data voltage stored in the storage capacitor Cst. The organic light emitting diode OLED emits light in response to the driving current generated by the driving transistor DT.

The compensation circuit CC compensates for a threshold voltage of the driving transistor DT using an initialization voltage Vinit and a reference voltage Vref. The subpixel including the compensation circuit CC may detect the threshold voltage of the driving transistor DT through a related art diode connection method or a related art source follower method, etc.

In the source follower method, a compensation capacitor is connected between a gate electrode and a source electrode of the driving transistor DT, and a source voltage of the driving transistor DT is followed to a gate voltage when the threshold voltage of the driving transistor DT is detected. Furthermore, in the source follower method, a drain electrode of the driving transistor DT is separated from the gate electrode and revives a power voltage from the first power supply line EVDD. Therefore, the source follower method may detect the threshold voltage having a negative value as well as the threshold voltage having a positive value.

The subpixel including the compensation circuit CC floats the gate electrode of the driving transistor DT when the threshold voltage of the driving transistor DT is sensed. The subpixel including the compensation circuit CC improves a compensation performance of the threshold voltage using the compensation capacitor connected between the gate electrode and the source electrode of the driving transistor DT and a parasitic capacitor of the driving transistor DT. For this, the compensation circuit CC includes at least one transistor and at least one capacitor.

Hereinafter, the circuit configuration of the subpixel is described in detail using the exemplary compensation circuit.

Figure 3:
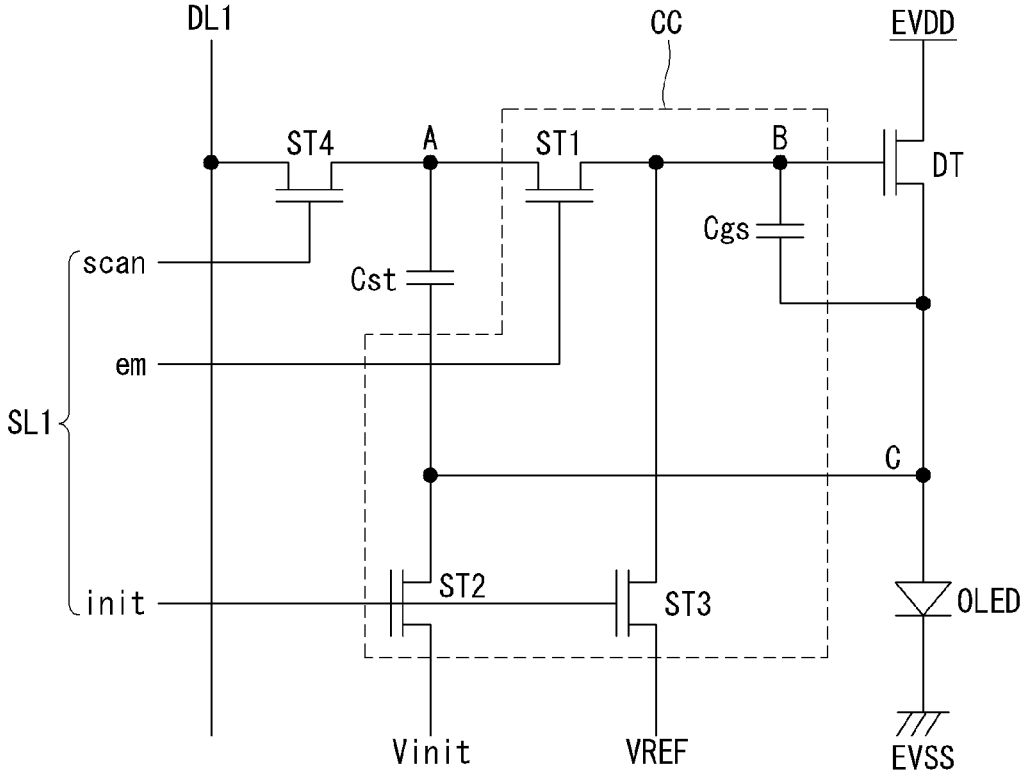
FIG. 3 shows an exemplary configuration of a compensation circuit shown in FIG. 2.
Figure 4:
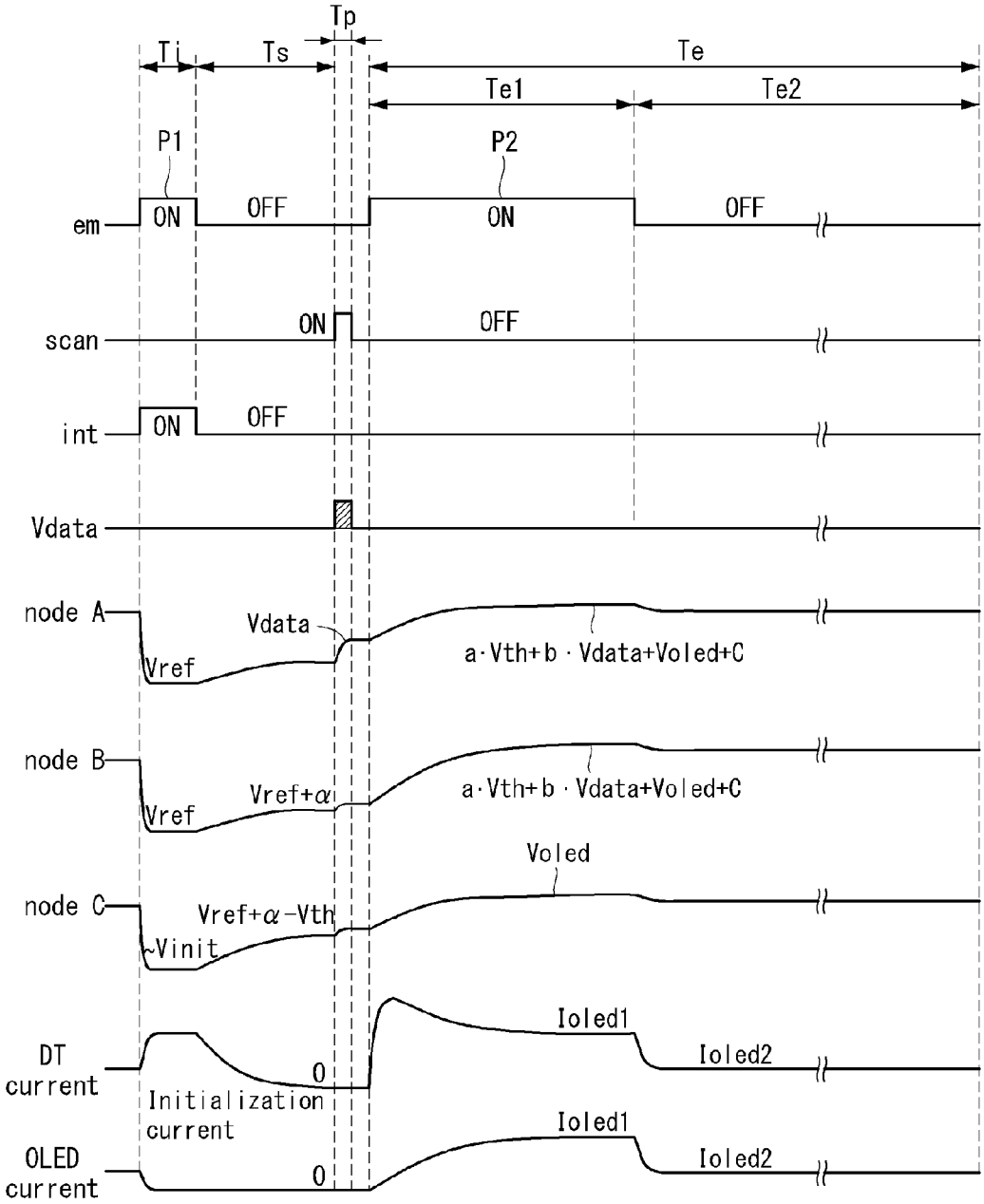
FIG. 4 is a driving waveform diagram of a subpixel shown in FIG. 3.

FIG. 3 shows an exemplary configuration of the compensation circuit shown in FIG. 2. FIG. 4 is a driving waveform diagram of the subpixel shown in FIG. 3.

As shown in FIG. 3, the compensation circuit CC includes a first transistor ST1, a second transistor ST2, a third transistor ST3, and a compensation capacitor Cgs. The configuration of the compensation circuit CC shown in FIG. 3 is merely an example for the sake of brevity and ease of reading. The embodiment of the invention is not limited thereto. The embodiment of the invention may adopt any configuration of the compensation circuit CC capable of compensating for the threshold voltage of the driving transistor DT using the reference voltage Vref.

The first transistor ST1 supplies the data voltage Vdata stored in a node A to a node B in response to an emission control signal 'em' supplied through a first scan line EM. A gate electrode of the first transistor ST1 is connected to the first scan line EM, a first electrode of the first transistor ST1 is connected to the node A, and a second electrode of the first transistor ST1 is connected to the node B. The first transistor ST1 is a node voltage switching transistor.

The second transistor ST2 supplies the initialization voltage Vinit to a node C in response to an initialization signal 'inn' supplied through a second scan line INIT. A gate electrode of the second transistor ST2 is connected to the second scan line INIT, a first electrode of the second transistor ST2 is connected to the node C, and a second electrode of the second transistor ST2 is connected to an initialization voltage line VINIT. The second transistor ST2 is an initialization voltage supply transistor.

The third transistor ST3 supplies the reference voltage Vref to the node B in response to the initialization signal 'inn' supplied through the second scan line INIT. A gate electrode of the third transistor ST3 is connected to the second scan line INIT, a first electrode of the third transistor ST3 is connected to the node B, and a second electrode of the third transistor ST3 is connected to a reference voltage line VREF. The third transistor ST3 is a reference voltage supply transistor.

The compensation capacitor Cgs enables the source follower method to be performed when the threshold voltage of the driving transistor DT is detected, thereby contributing to the improvement of the compensation for the threshold voltage. One terminal of the compensation capacitor Cgs is connected to the gate electrode of the driving transistor DT, and the other terminal is connected to the node C.

As the compensation circuit CC is configured as described above, the switching transistor SW supplies the data voltage Vdata to the node A in response to a switching signal 'scan' supplied through a third scan line SCAN. A gate electrode of the switching transistor SW is connected to the third scan line SCAN, a first electrode of the switching transistor SW is connected to the node A, and a second electrode of the switching transistor SW is connected to the first data line DL1. One terminal of the storage capacitor Cst is connected to the node A, and the other terminal is connected to the node C. The gate electrode of the driving transistor DT is connected to the node B, a first electrode of the driving transistor DT is connected to the node C, and a second electrode of the driving transistor DT is connected to the first power supply line EVDD. An anode electrode of the organic light emitting diode OLED is connected to the node C, and a cathode electrode of the organic light emitting diode OLED is connected to the first power supply line EVDD. In the above description, the embodiment of the invention selects the first electrode of the transistor as a source electrode and selects the second electrode of the transistor as a drain electrode as an example, but is not limited thereto.

As shown in FIG. 4, the subpixel including the compensation circuit CC is divided into an initialization period Ti in which the nodes A, B, and C are initialized to a specific voltage, a sensing period Ts in which the threshold voltage of the driving transistor DT is detected and stored, a programming period Tp in which the data voltage Vdata is applied, and an emission period Te in which the driving current applied to the organic light emitting diode OLED is compensated using the threshold voltage and the data voltage Vdata irrespective of the threshold voltage. A blank period for delaying a predetermined period of time may be present between the programming period Tp and the emission period Te. The emission period Te is subdivided into first and second emission periods Te1 and Te2. The more detailed description related to the compensation circuit CC refers to Korean Patent Application No. 10-2012-0095604.

As described above, the subpixel including the compensation circuit CC has various deviations due to various signal lines for driving the transistors. Hence, when a specific pattern (for example, a single color pattern such as a grey pattern) is implemented, a luminance spot appears on the panel. The luminance spot is described in relation to a layout of the scan lines of the panel.

Figure 5:
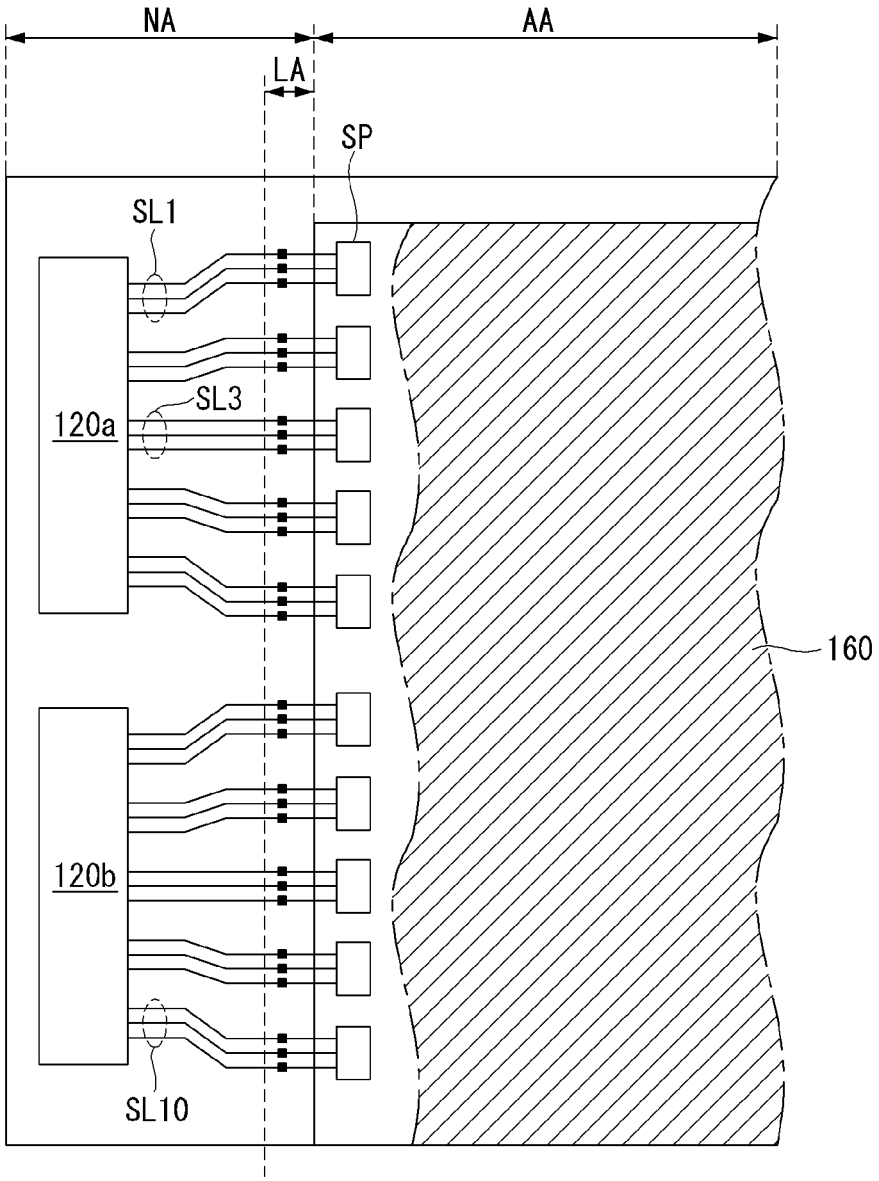
FIG. 5 shows a layout of scan lines of a panel including a subpixel shown in FIG. 3.
Figure 6:
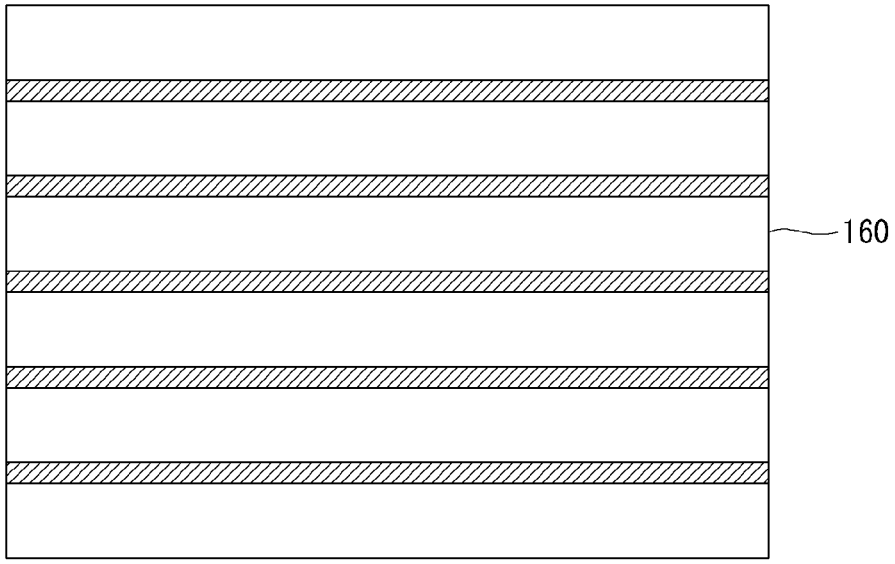
FIG. 6 shows a luminance spot of a horizontal direction appearing on a panel.
Figure 7:
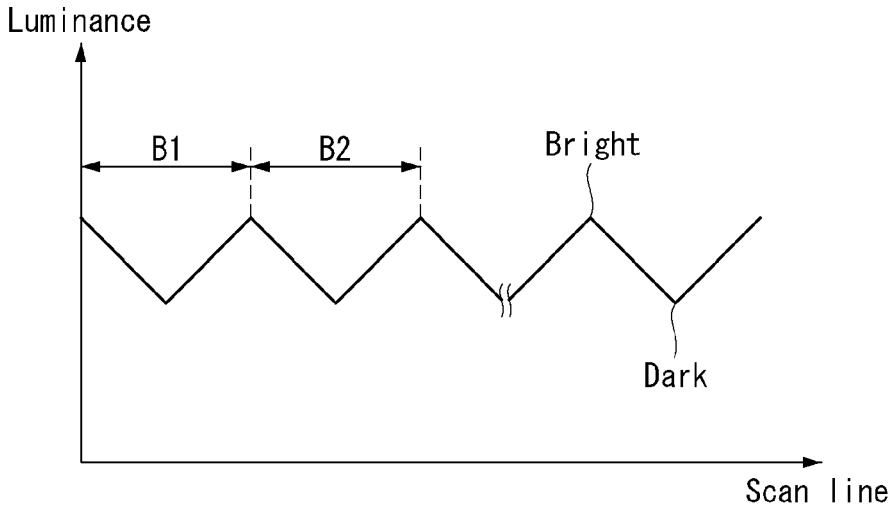
FIG. 7 is a graph illustrating a luminance deviation of each scan line depending on the luminance spot of FIG. 6.

FIG. 5 shows an exemplary layout of scan lines of the panel including the subpixel shown in FIG. 3. FIG. 6 shows a luminance spot of a horizontal direction appearing on the panel. FIG. 7 is a graph illustrating a luminance deviation of each scan line depending on the luminance spot of FIG. 6.

As shown in FIGS. 3 to 5, scan drivers 120*a* and 120*b* are formed in a non-display area NA of the panel 160 including the subpixels SP each including the compensation circuit CC, and the subpixels SP are formed in a display area AA of the panel 160. The scan drivers 120*a* and 120*b* are formed in the non-display area NA of the panel 160 in a gate-in panel (GIP) manner along with a process for forming the transistors included in the subpixels SP.

The scan lines SL1 to SL10 for connecting the scan drivers 120*a* and 120*b* and the subpixels SP are connected to one another in a link area LA of the panel 160. Each of the scan lines SL1 to SL10 includes first to third scan lines SCAN, EM, and INIT.

Because the subpixels SP each including the compensation circuit CC require the plurality of scan lines, a link resistance deviation between the lines and a capacitance deviation are generated due to a limitation of a layout of the scan lines in the narrow non-display area NA. Further, a deviation is generated in a threshold voltage sampling value due to a kickback voltage.

The link resistance deviation between the lines refers routing states of the first scan line SL1 and the third scan line SL3. A length of the first scan line SL1 is longer than a length of the third scan line SL3. A difference between routing distances of lines generates the resistance deviation and the capacitance deviation. The accompanying drawings are shown for helping the understanding of the link deviation between the lines. Thus, the layout of the scan lines is not limited the accompanying drawings.

As described above, when the link resistance deviation, the capacitance deviation, and the threshold voltage sampling deviation are generated, a luminance spot of a transverse direction, in which bright and dark patterns repeatedly appear, is generated in the transverse direction (i.e., the scan line direction) of the panel 160 as shown in FIG. 6. As can be seen from a first block B1 and a second block B2 shown in FIG. 7, the luminance spot of the transverse direction, for example, bright and dark patterns repeatedly appear along the scan line at regular intervals.

The embodiment of the invention conducted an experiment for improving the luminance spot of the transverse direction and obtained the following result.

Figure 8:
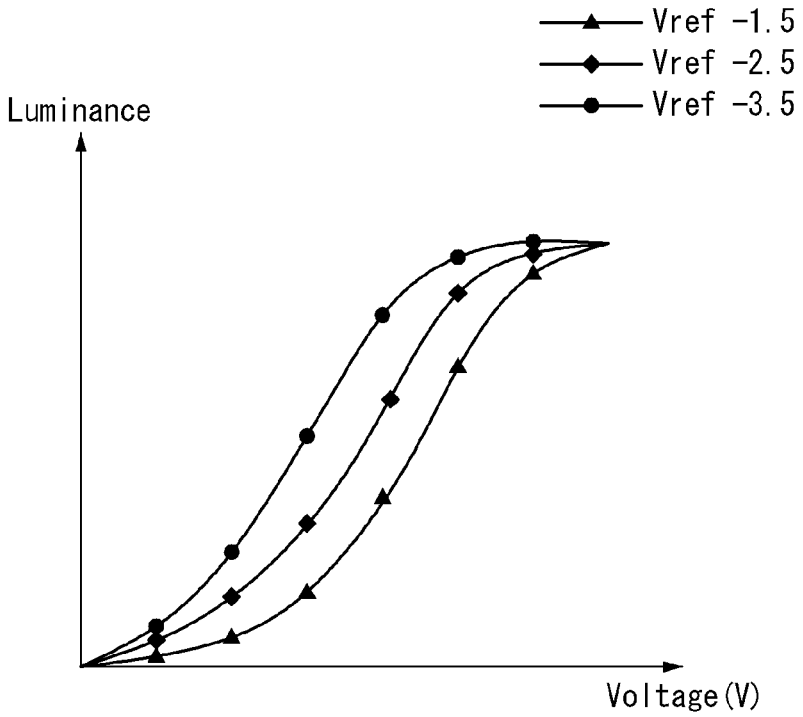
FIG. 8 is a graph illustrating a relationship between a reference voltage and a luminance displayed on a display panel.
Figure 9:
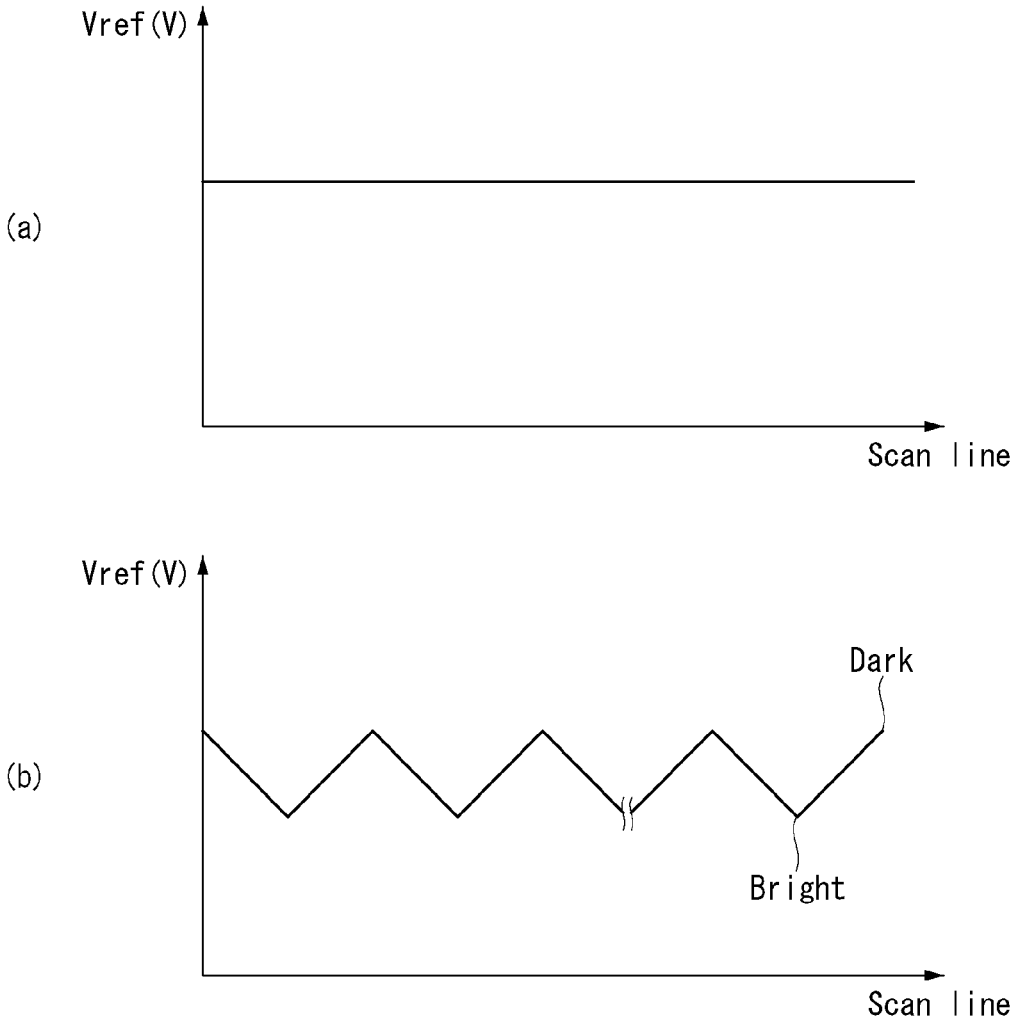
FIG. 9 is a graph illustrating a related art method for supplying a reference voltage and a method for supplying a reference voltage according to the first embodiment of the invention.
Figure 10:
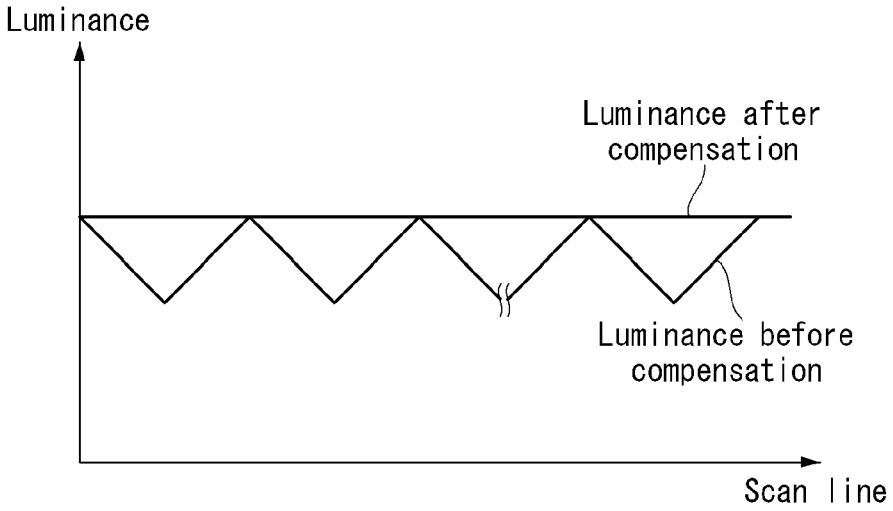
FIG. 10 is a graph for explaining a luminance compensation concept based on a method for supplying a reference voltage according to the first embodiment of the invention.

FIG. 8 is a graph illustrating a relationship between the reference voltage and the luminance displayed on the display panel. FIG. 9 is a graph illustrating a related art method for supplying the reference voltage and a method for supplying the reference voltage according to the first embodiment of the invention. FIG. 10 is a graph for explaining a luminance compensation concept based on the method for supplying the reference voltage according to the first embodiment of the invention.

As shown in FIG. 8, a luminance of the panel when the reference voltage Vref was set to −3.5V was greater than a luminance of the panel when the reference voltage Vref was set to −2.5V. Further, a luminance of the panel when the reference voltage Vref was set to −1.5V was less than a luminance of the panel when the reference voltage Vref was set to −2.5V. Namely, as described above, the luminance of the subpixel including the compensation circuit may change depending on the reference voltage Vref.

As shown in (a) of FIG. 9, in the related art, all of the reference voltages Vref were set to the same value irrespective of the scan lines. On the other hand, as shown in (b) of FIG. 9, the embodiment of the invention varies the reference voltage Vref of each scan line based on the fact that the luminance may change depending on the reference voltage Vref.

(b) of FIG. 9 shows a variation of the reference voltage Vref capable of adopting when the luminance spot of the transverse direction shown in FIG. 7 appears. Thus, when the reference voltage Vref varies in the form shown in (b) of FIG. 9, the luminance spot of the transverse direction on the panel is compensated as shown in FIG. 10. In FIG. 10, a luminance before the compensation indicates the luminance appearing on the panel based on the related art method for supplying the reference voltage, and a luminance after the compensation indicates the luminance appearing on the panel based on the method for supplying the reference voltage according to the embodiment of the invention.

The configuration of the organic light emitting display according to the embodiment of the invention is described below.

Figure 11:
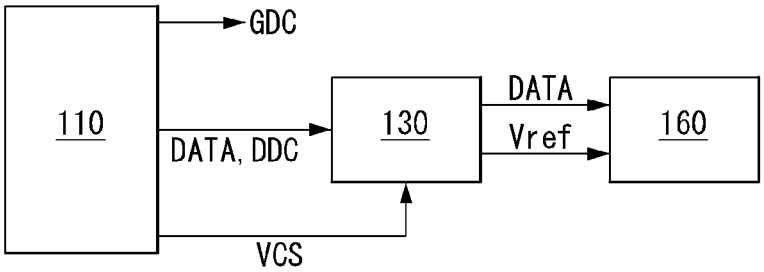
FIG. 11 shows a partial configuration of an organic light emitting display according to the first embodiment of the invention.
Figure 12:
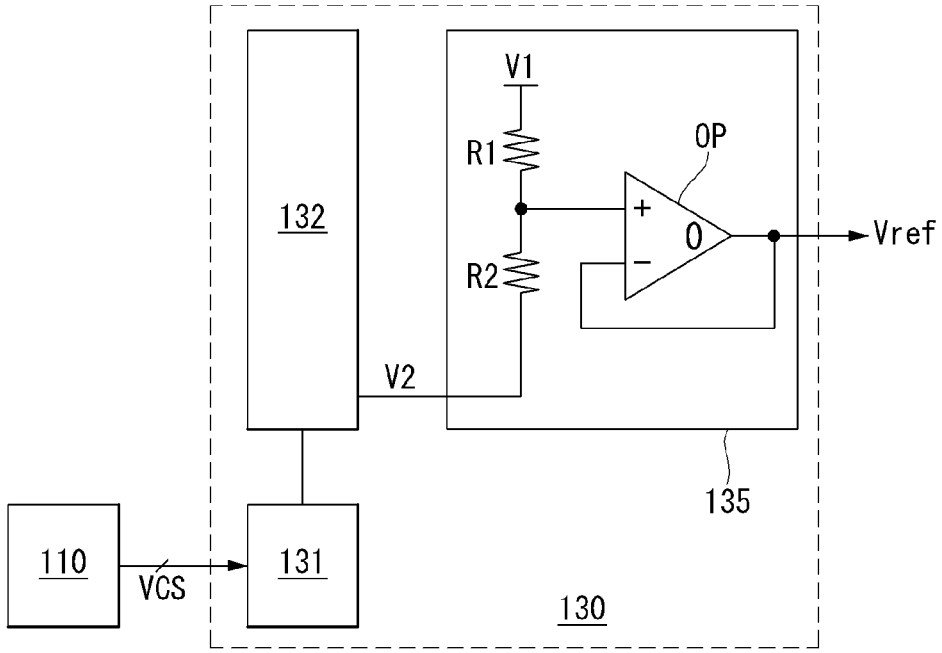
FIG. 12 shows a first example of a configuration of a reference voltage compensation unit.
Figure 13:
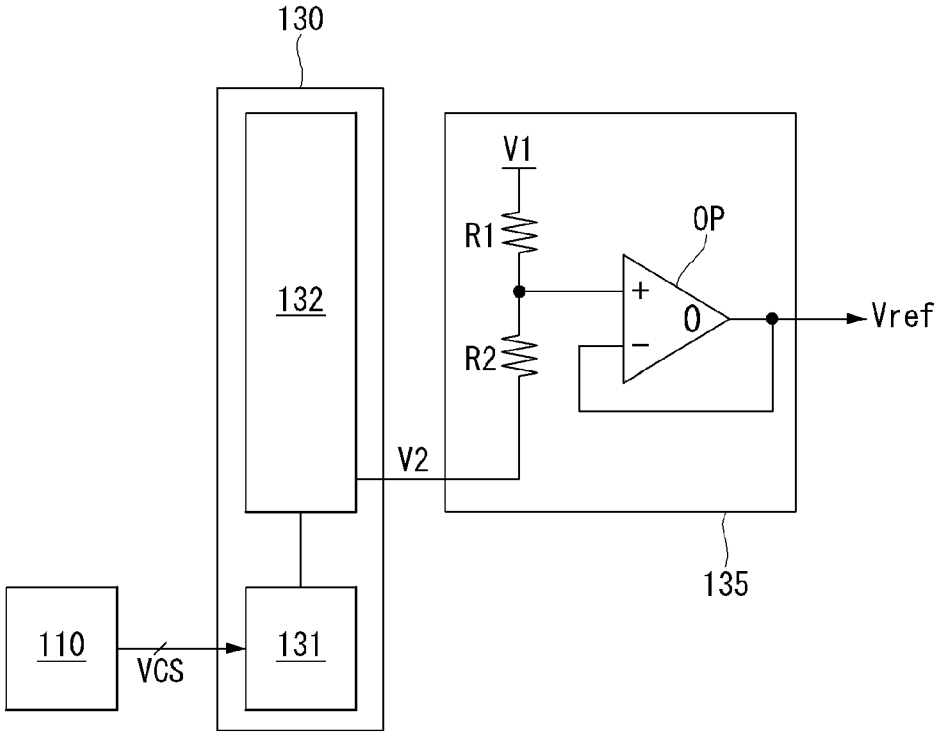
FIG. 13 shows a second example of a configuration of a reference voltage compensation unit.

FIG. 11 shows a partial configuration of the organic light emitting display according to the first embodiment of the invention. FIG. 12 shows a first example of a configuration of a reference voltage compensation unit. FIG. 13 shows a second example of the configuration of the reference voltage compensation unit.

As shown in FIG. 12, a reference voltage compensation unit 135 may be included in the data driver 130. Alternatively, as shown in FIG. 13, the reference voltage compensation unit 135 may be configured separately from the data driver 130.

As shown in FIGS. 11 to 13, the reference voltage compensation unit 135 varies the reference voltage Vref every at least one scan line and supplies the reference voltage Vref to the subpixels of the panel 160. The reference voltage compensation unit 135 divides a first voltage V1 and a second voltage V2 output from a digital-to-analog converter (DAC) 132 included in the data driver 130 to produce the reference voltage Vref.

For this, the reference voltage compensation unit 135 includes a first resistor R1, an operational amplifier (op-amp) OP, and a second resistor R2. One terminal of the first resistor R1 is connected to a first voltage terminal, and the other terminal is connected to one terminal of the second resistor R2 and a non-inverting terminal (+) of the op-amp OP. The non-inverting terminal (+) of the op-amp OP is connected to the other terminal of the first resistor R1, and an inverting terminal (−) of the op-amp OP is connected to an output terminal 'O' of the op-amp OP. One terminal of the second resistor R2 is connected to the other terminal of the first resistor R1 and the non-inverting terminal (+) of the op-amp OP, and the other terminal is connected to a second voltage terminal.

The reference voltage compensation unit 135 divides the first voltage V1 supplied through the one terminal of the first resistor R1 and the second voltage V2 supplied through the other terminal of the second resistor R2 to produce the reference voltage Vref which will be output through the output terminal 'O' of the op-amp OP. The first voltage V1 supplied from the first voltage terminal is set to a fixed value, and the second voltage V2 supplied from the second voltage terminal is set to have a varying value.

The reference voltage Vref output from the reference voltage compensation unit 135 may be selected between about 0V and −10V. The embodiment of the invention is not limited thereto. Although the voltage value may vary depending on the voltage, which will be divided, the first voltage V1 may be selected as a negative voltage equal to or less than 0V, and the second voltage V2 may be selected as a positive voltage.

The timing controller 110 supplies the data signal DATA, the data timing control signal DDC, and a voltage change signal VCS to the data driver 130. The timing controller 110 may supply the voltage change signal VCS, which changes the second voltage V2 output from the DAC 132 through the communication with the data driver 130. For example, the timing controller 110 may supply the voltage change signal VCS, which communicates with an interface unit 131 included in the data driver 130 through $I^2C$ communication manner and indicates the variation of the reference voltage Vref output from the reference voltage compensation unit 135.

As described above, the data driver 130 changes the second voltage V2 in response to the voltage change signal VCS output from the timing controller 110, and the reference voltage compensation unit 135 varies the reference voltage Vref depending on a change value of the second voltage V2 output from the data driver 130. Namely, the reference voltage compensation unit 135 varies the reference voltage Vref in response to the voltage change signal VCS output from the timing controller 110.

However, it is designed so that the second voltage V2 is supplied to the reference voltage compensation unit 135 using the DAC 132 included in the data driver 130. For example, when the reference voltage compensation unit 135 includes the interface unit 131 for communicating with the timing controller 110 and the DAC 132 for outputting the second voltage V2, the reference voltage compensation unit 135 may be configured separately from the data driver 130.

The reference voltage compensation unit 135 varies the reference voltage Vref every at least one scan line and supplies the reference voltage Vref to the subpixels of the panel 160, so as to compensate for the luminance spot appearing on the panel 160. For this, the timing controller 110 may be configured as follows.

Figure 14:
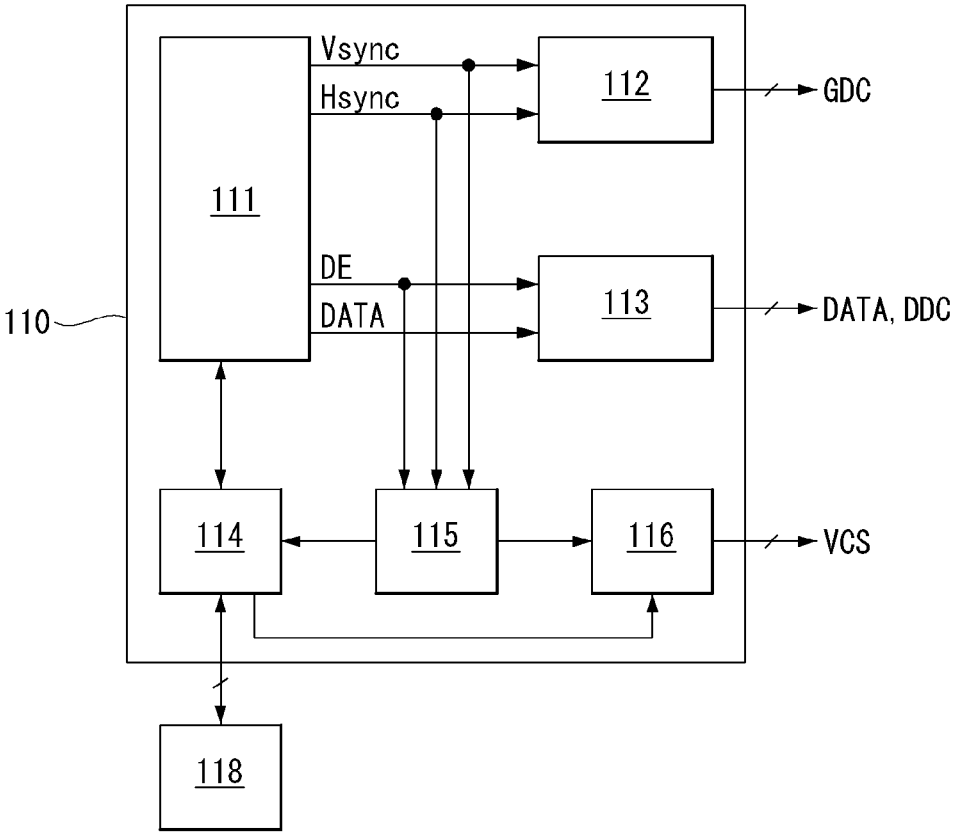
FIG. 14 is a block diagram of a timing controller according to the first embodiment of the invention.
Figure 15:
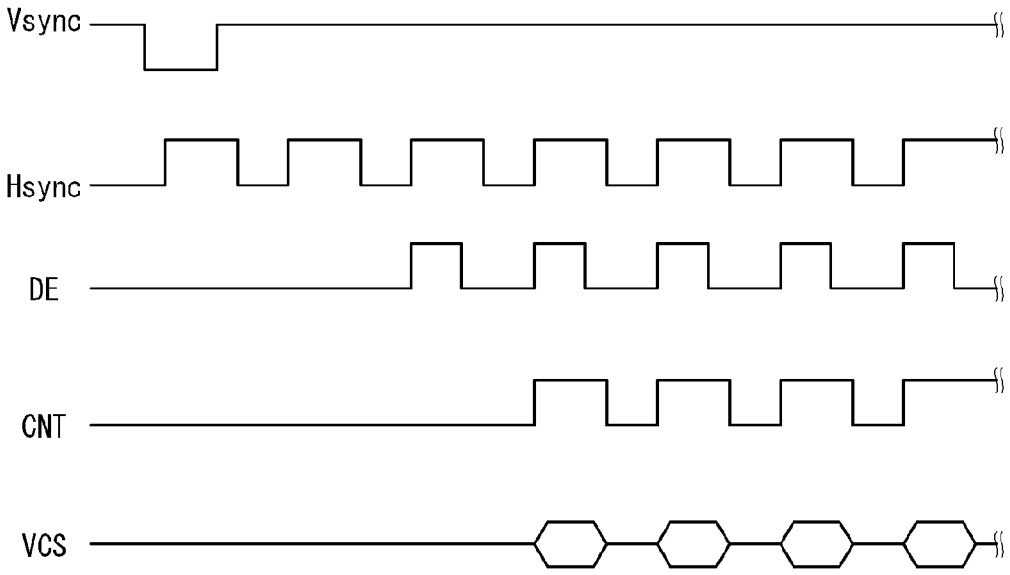
FIG. 15 is a waveform diagram of a signal for schematically explaining a time point at which a voltage change signal is output.
Figure 16:
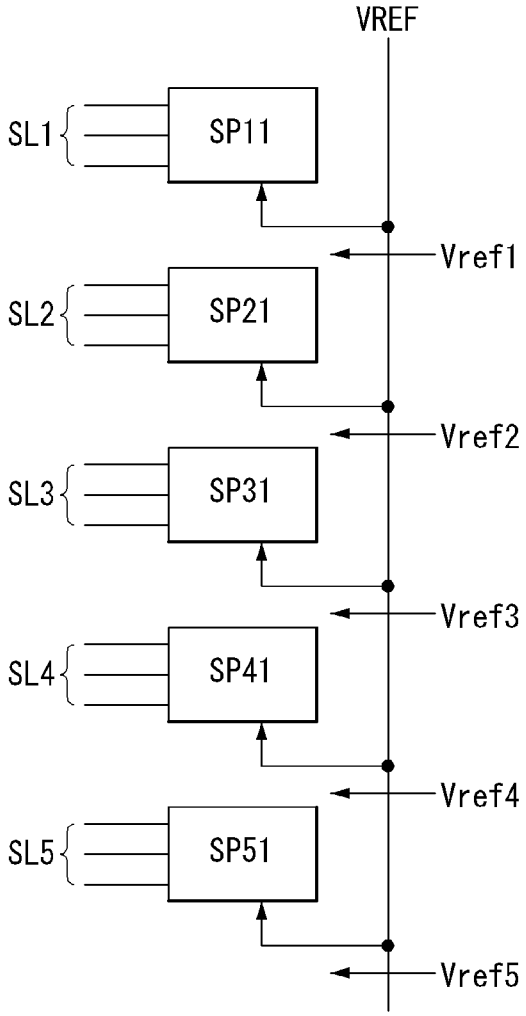
FIG. 16 shows an example where a reference voltage varies on each scan line according to the first embodiment of the invention.

FIG. 14 is a block diagram of the timing controller according to the first embodiment of the invention. FIG. 15 is a waveform diagram of a signal for schematically explaining a time point at which the voltage change signal is output. FIG. 16 shows an example where the reference voltage varies on each scan line according to the first embodiment of the invention.

As shown in FIGS. 14 and 15, the timing controller 110 includes a data processing unit 111, a first controller 112, a second controller 113, a lookup table 114, a counter 115, an interface unit 116, and a memory 118.

The first controller 112 outputs the gate timing control signal GDC, including a gate start pulse, a gate shift clock, a gate output enable signal, etc., generated based on the vertical sync signal Vsync and the horizontal sync signal Hsync received from the data processing unit 111.

The second controller 113 outputs the data signal DATA and the data timing control signal DDC, including a source start pulse, a source sampling clock, a source output enable signal, etc., generated based on the data enable signal DE received from the data processing unit 111.

The counter 115 produces count information CNT capable of deciding a time point, at which the reference voltage Vref is supplied to each scan line, based on the vertical sync signal Vsync, the horizontal sync signal Hsync, and the data enable signal DE output from the data processing unit 111. The counter 115 transmits the count information CNT to the data processing unit 111, the lookup table 114, and the interface unit 116.

The memory 118 stores the voltage change signal VCS corresponding to information about the luminance spot of the transverse direction or information about various luminance spots. The voltage change signal VCS is stored in the memory 118 as values capable of adjusting the voltage output from the DAC 132 based on a luminance map of the lookup table 114. The memory 118 may be configured separately from the timing controller 110 or may be included in the timing controller 110.

The lookup table 114 records the information about the luminance spot of the transverse direction or the information about the various luminance spots appearing on each scan line of the panel 160. The information about the luminance spot of the transverse direction or the information about the various luminance spots appearing on each scan line of the panel 160 are recorded based on the luminance map of the lookup table 114 measuring the luminance of the panel 160. The lookup table 114 readouts the voltage change signal VCS corresponding to the information about the luminance spot of the transverse direction or the information about the various luminance spots from the memory 118 and transmits the voltage change signal VCS to the interface unit 116.

The data processing unit 111 controls the first controller 112, the second controller 113, the lookup table 114, the interface unit 116, and the memory 118. The data processing unit 111 supplies the vertical sync signal Vsync and the horizontal sync signal Hsync to the first controller 112 and supplies the data signal DATA and the data enable signal DE to the second controller 113.

The data processing unit 111 decides the time point, at which the reference voltage Vref is supplied to each scan line, using the count information CNT received from the counter 115. The data processing unit 111 analyzes the information about the luminance spot appearing on each scan line of the panel 160 through the lookup table 114 and readouts the voltage change signal VCS corresponding to the information through the memory 118. The data processing unit 111 controls an output of the interface unit 116, so that the readout voltage change signal VCS can be supplied at the time point, at which the reference voltage Vref is supplied to each scan line of the panel. In this instance, the data processing unit 111 may control a signal output time of the interface unit 116, so that the voltage change signal VCS is output at the time point, at which the reference voltage Vref is supplied to each scan line of the panel.

The above configuration described the configuration indirectly controlling the reference voltage compensation unit 135 using the timing controller 110 as an example. The embodiment of the invention described that the timing controller 110 includes the data processing unit 111, the lookup table 114, the counter 115, the interface unit 116, and the memory 118 and outputs the voltage change signal VCS as an example. However, the data processing unit 111, the lookup table 114, the counter 115, the interface unit 116, and the memory 118 included in the timing controller 110 are configured by functionally dividing a block outputting the voltage change signal VCS. Thus, the components 111, 114, 115, 116, and 118 included in the timing controller 110 may be partially combined or may be subdivided.

As shown in FIG. 16, first to fifth reference voltages Vref1 to Vref5 output through a reference voltage line VREF vary and are supplied to 11th, 21th, 31th, 41th, and 51th subpixels SP11, SP21, SP31, SP41, and SP51 positioned on the first to fifth scan lines SL1 to SL5. In this instance, at least one of the first to fifth reference voltages Vref1 to Vref5 may be different from the remaining reference voltages. For example, when the luminance deviation is generated in all the 11th, 21th, 31th, 41th, and 51th subpixels SP11, SP21, SP31, SP41, and SP51, the first to fifth reference voltages Vref1 to Vref5 may be different from one another.

As shown in FIG. 16, the reference voltage line VREF is shared with all of the subpixels SP. Thus, the reference voltages Vref1 to Vref5 output through the reference voltage line VREF are dividedly supplied to the subpixels SP11, SP21, SP31, SP41, and SP51 in a time division manner.

In the above description, the embodiment of the invention described that the reference voltage of each scan line varied line by line. However, as shown in FIG. 7, the luminance spot appearing on the panel may uniformly appear in the transverse direction at regular intervals. In this instance, the reference voltage of the first block B1 and the reference voltage of the second block B2 are set to be equal to each other. Namely, the reference voltage corresponds to the number of scan lines included in the block having the luminance reduction and is set to first to nth reference voltages, where 'n' is an integer equal to or greater than 2. The first to nth reference voltages are equally used in first to mth blocks, where 'm' is an integer equal to or greater than 2.

A method for driving the organic light emitting display according to the first embodiment of the invention is described below with reference to FIGS. 1 to 16 as well as FIG. 17 for the understanding of the explanation.

Figure 17:
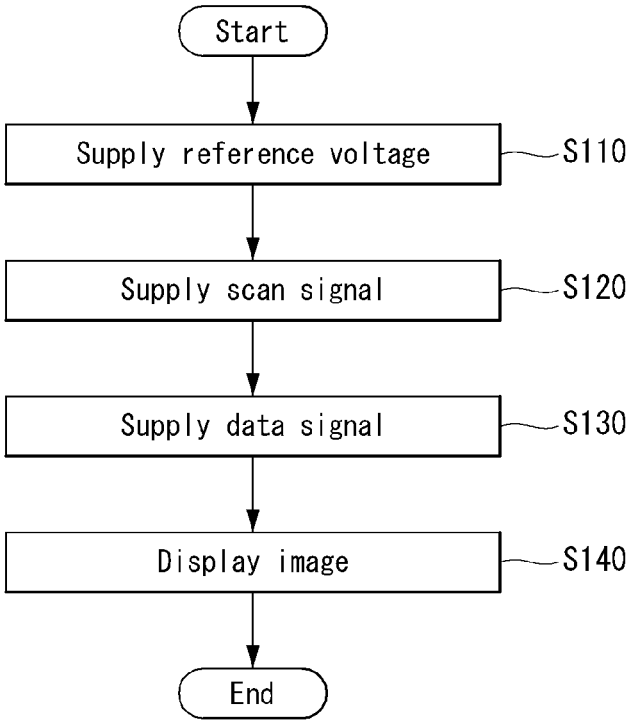
FIG. 17 is a flow chart showing a method for driving an organic light emitting display according to the first embodiment of the invention.

FIG. 17 is a flow chart showing a method for driving the organic light emitting display according to the first embodiment of the invention.

As shown in FIGS. 1 to 17, the method for driving the organic light emitting display according to the first embodiment of the invention may include a reference voltage supply step S110, a scan signal supply step S120, a data signal supply step S130, and an image display step S140.

The reference voltage supply step S110 is a step of supplying the reference voltage Vref to the reference voltage line VREF connected to the subpixels SP included in the panel 160.

The scan signal supply step S120 is a step of supplying the scan signal through the scan lines SL1 to SLm connected to the subpixels SP included in the panel 160. One scan line includes the first to third scan lines EM, INIT, and SCAN. Thus, the fact that the supply of the scan signal to one scan line indicates the supply of the emission control signal 'em', the initialization signal 'init', and the switching signal 'scan' through the first to third scan lines EM, INIT, and SCAN. In the embodiment of the invention, the priority order of the emission control signal 'em' and the initialization signal 'init' supplied through the first and second scan lines EM and INIT is earlier than the priority order of the switching signal 'scan' supplied through the third scan line SCAN as an example. However, the polarity order of the signals may change depending on the configuration of the circuit.

The data signal supply step S130 is a step of supplying the data signal DATA through the data line DL1 connected to the subpixels SP included in the panel 160.

The image display step S140 is a step in which the subpixels SP included in the panel 160 emit light and display the image.

In the reference voltage supply step S110, the reference voltage Vref varies on each of the scan lines SL1 to SLm of the panel 160 and is supplied to the subpixels SP. In this instance, the reference voltage Vref varies every at least one scan line of the panel 160 and is supplied to the subpixels SP. In the reference voltage supply step S110, the reference voltage Vref is supplied to the subpixels SP, so that the reference voltage Vref has the voltage deviation at regular intervals. Hence, the luminance spot of the transverse direction appearing on each scan line of the panel 160 is compensated.

The method illustrated in FIG. 17 briefly described that the reference voltage Vref varied on each of the scan lines SL1 to SLm of the panel 160 and was supplied to the subpixels SP. However, the method for driving the organic light emitting display according to the embodiment of the invention should be comprehended as the method described throughout FIGS. 1 to 16.

Further, in the above description, all of the reference voltages Vref corresponding to the scan lines SL1 to SLm vary. However, the luminance spot appearing on the panel may be uniformly generated in the transverse direction at regular intervals as shown in FIG. 7. In this instance, the reference voltage of the first block B1 and the reference voltage of the second block B2 are set to be equal to each other. Namely, as shown in FIG. 7, the reference voltage Vref corresponds to the number of scan lines included in the block having the luminance reduction and is set to the first to nth reference voltages. The first to nth reference voltages are equally used in the first to mth blocks. Thus, the reference voltage Vref may have the same value in all of the blocks in a longitudinal direction of the panel.

The first embodiment of the invention provides the organic light emitting display and the method for driving the same capable of preventing the luminance spot appearing on the panel due to the output deviation of the scan driver when the compensation circuit is used in each subpixel. Further, the first embodiment of the invention measures the luminance displayed on the panel when the compensation circuit is used in each subpixel, and varies the reference voltage based on the measured luminance, thereby providing the organic light emitting display and the method for driving the same capable of preventing the various luminance spots.

Second Embodiment

Figure 18:
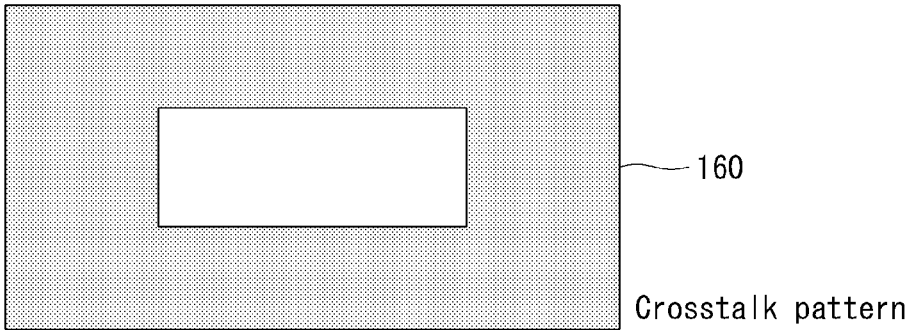
FIGS. 18 and 19 show a pattern of a crosstalk generated when a compensation circuit is used.
Figure 19:
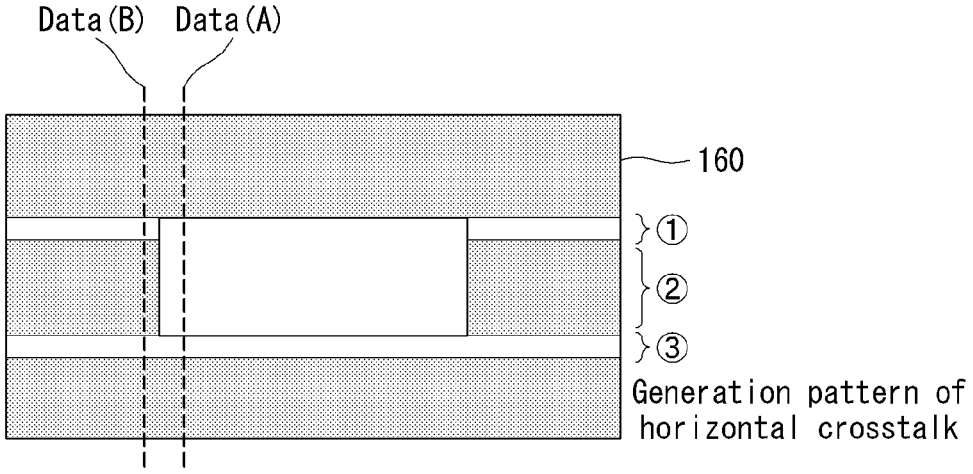
Figure 20:
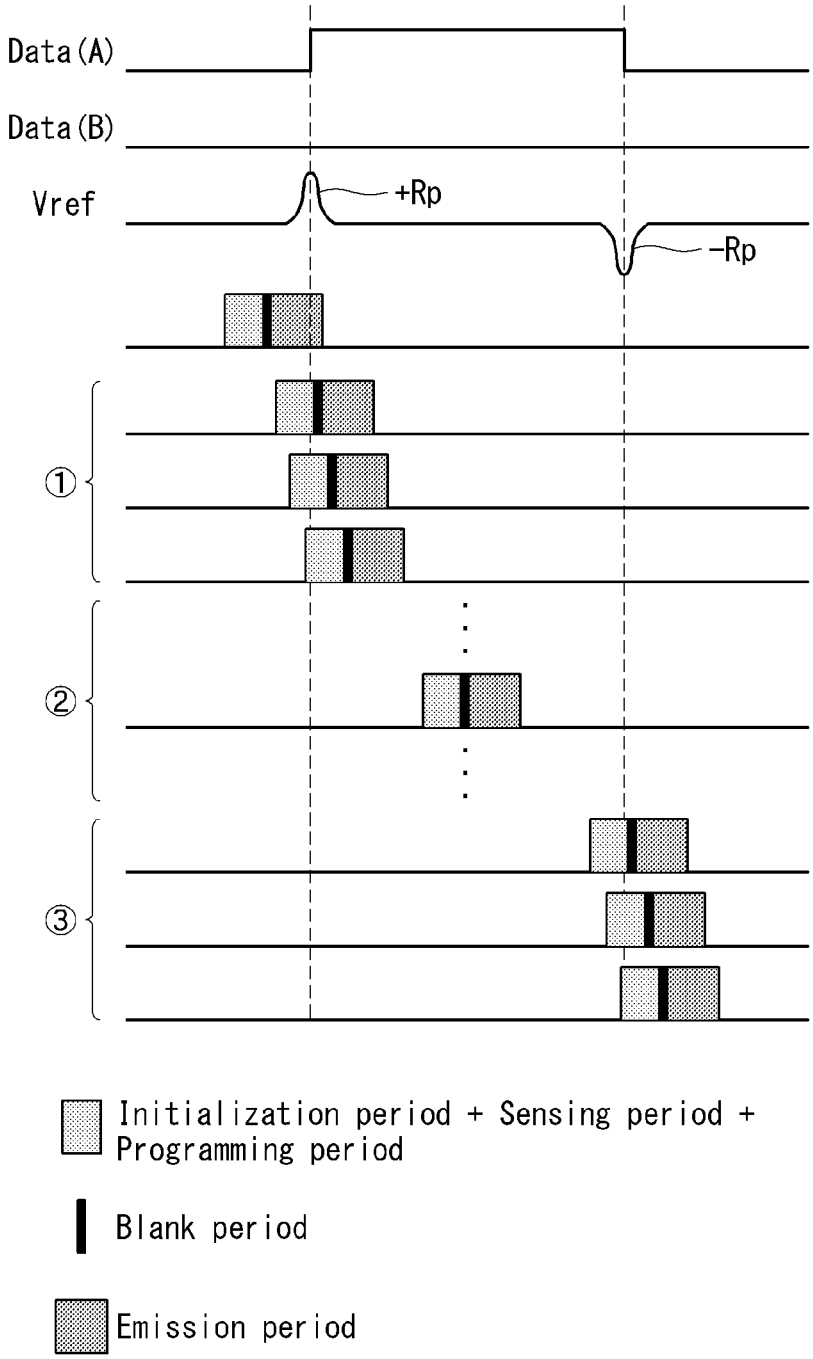
FIG. 20 is a waveform diagram showing a type of a ripple of a reference voltage when a crosstalk is generated.

FIGS. 18 and 19 show a pattern of a crosstalk generated when a compensation circuit is used. FIG. 20 is a waveform diagram showing a type of a ripple of a reference voltage when a crosstalk is generated.

As shown in FIG. 18, as a pattern for deciding whether or not a crosstalk is generated in a panel 160, for example, a black is displayed on a background of the panel 160, and a white rectangular box is displayed in a middle portion of the panel 160. As a result, as can be seen from a color difference between portions ①, ②, and ③ shown in FIG. 19, a horizontal crosstalk is generated.

In this instance, as shown in FIG. 20, ripples +Rp and −Rp are generated in a reference voltage Vref in an area, to which an Ath data signal Data(A) is supplied, and an area, to which a Bth data signal Data(B) is supplied. The positive ripple +Rp generated in the reference voltage Vref is generated at a time point at which the supply of the Ath data signal Data(A) starts, and the negative ripple −Rp generated in the reference voltage Vref is generated at a time point at which the supply of the Ath data signal Data(A) ends.

As described above, a reason why the ripples +Rp and −Rp are generated in the reference voltage Vref is because a voltage level sharply changes when the Bth data signal Data(B) is changed to the Ath data signal Data(A).

More specifically, the reason why the ripples +Rp and −Rp are generated in the reference voltage Vref is because a capacitive coupling is generated between a data line used to supply the Ath data signal Data(A) and a reference voltage line used to supply the reference voltage Vref. In this instance, the ripples +Rp and −Rp of the reference voltage Vref are spread from left to right because of an influence of a parasitic capacitive coupling inside the panel 160. Further, the ripples +Rp and −Rp of the reference voltage Vref affect operations of all of subpixels positioned at boundaries at which the box pattern starts and ends, a horizontal crosstalk is generated in the panel 160.

Signals having waveforms ①, ②, and ③ shown in FIG. 20 are supplied to the portions ①, ②, and ③ shown in FIG. 19. As can be seen from the waveforms ①, ②, and ③ shown in FIG. 20, the horizontal crosstalk appears as a band shape forming a transverse line in the area, in which the box pattern starts and ends. The horizontal crosstalk is closely related to the driving waveform of the subpixel.

More specifically, in the driving waveforms ①, ②, and ③ shown in FIG. 20, each of an initialization period Ti and a sensing period Ts is set to be equal to or longer than one horizontal period. Because of this, as shown in FIG. 20, the subpixels in the initialization period Ti, the sensing period Ts, and a programming period are positioned on lines corresponding to a sum of the initialization period Ti, the sensing period Ts, and the programming period in the area, in which the box pattern starts and ends. Thus, the horizontal crosstalk appears as the band shape.

Therefore, when a specific pattern is implemented in the panel including the compensation circuit, the horizontal crosstalk is generated. The horizontal crosstalk generates the ripples in the reference voltage supplied to the compensation circuit. Thus, the ripples are prevented as follows.

Hereinafter, configuration of the device for achieving the embodiment of the invention is described.

Figure 21:
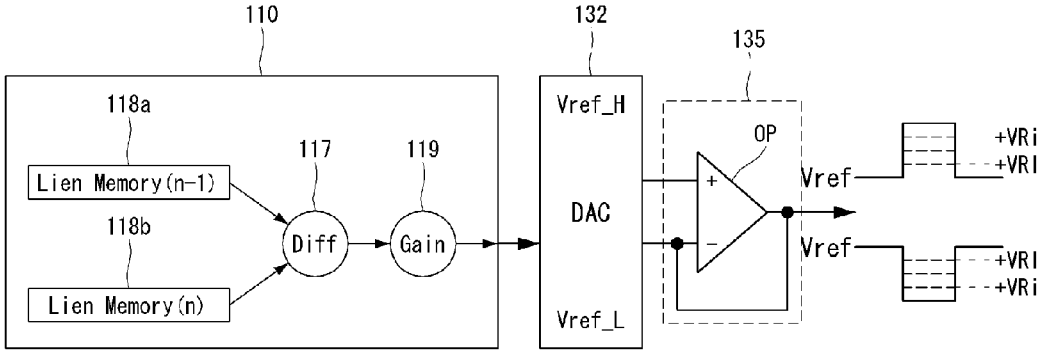
FIG. 21 shows a partial configuration of an organic light emitting display according to a second embodiment of the invention.
Figure 22:
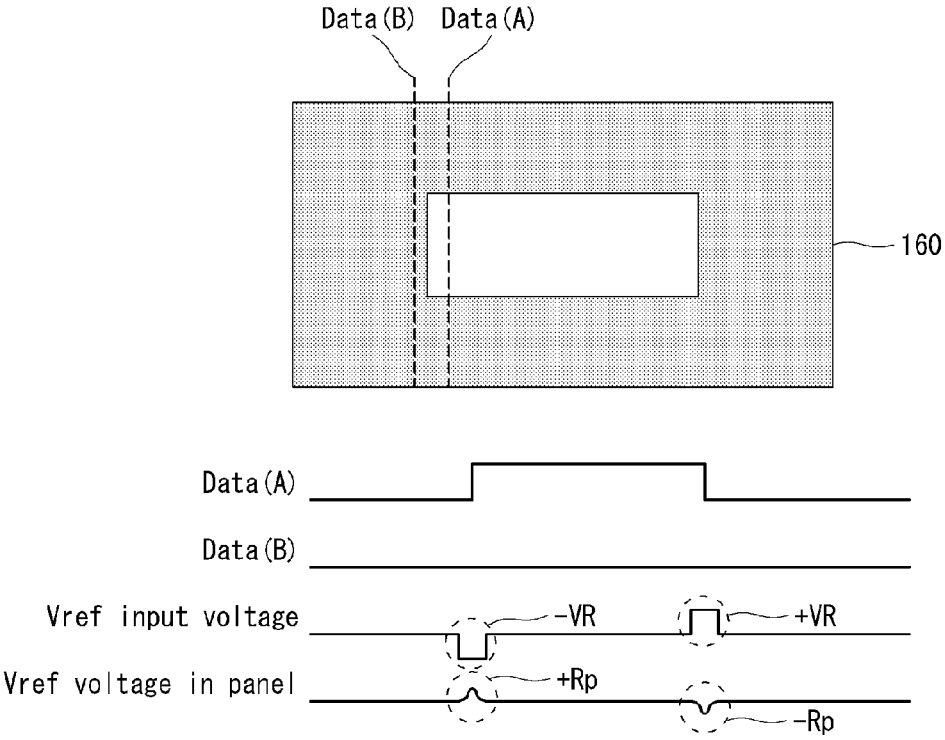
FIG. 22 shows a pattern and a waveform for explaining a crosstalk compensation concept based on a method for supplying a reference voltage according to the second embodiment of the invention.

FIG. 21 shows a partial configuration of an organic light emitting display according to a second embodiment of the invention. FIG. 22 shows a pattern and a waveform for explaining a crosstalk compensation concept based on a method for supplying a reference voltage according to the second embodiment of the invention.

As shown in FIGS. 21 and 22, a timing controller 110 estimates that the ripples +Rp and −Rp shown in FIG. 20 are generated in the reference voltage Vref supplied to the panel 160. Thus, the timing controller 110 controls a reference voltage compensation unit 135, so that the reference voltage compensation unit 135 outputs a reference voltage Vref including reverse voltages −VR and +VR opposite the ripples +Rp and −Rp.

As shown in FIG. 22, when the reference voltage compensation unit 135 outputs the reference voltage Vref including the reverse voltages −VR and +VR, the positive ripple +Rp shown in FIG. 20 is canceled or omitted by the negative reverse voltage −VR. Further, the negative ripple −Rp shown in FIG. 20 is canceled or omitted by the positive reverse voltage +VR.

For this, the timing controller 110 includes a difference value calculating unit 117 and a gain adjusting unit 119. The difference value calculating unit 117 reads an (n−1)th data signal (i.e., a previous data signal) and an nth data signal (i.e., a current data signal). The difference value calculating unit 117 may read the (n−1)th data signal and the nth data signal from two memories 118*a* and 118*b* included in the inside or the outside of the timing controller 110, but is not limited thereto. The difference value calculating unit 117 compares the (n−1)th data signal with the nth data signal and obtains a difference value Diff between them. For example, the difference value calculating unit 117 may obtain the difference value Diff corresponding to a current difference, a voltage difference, or a luminance difference, etc. between images or patterns displayed on the panel 160 by comparing the (n−1)th data signal with the nth data signal.

The gain adjusting unit 119 outputs a voltage change signal VCS capable of adjusting the reference voltage Vref based on the difference value Diff received from the difference value calculating unit 117. The gain adjusting unit 119 adds the difference values Diff received from the difference value calculating unit 117 and then multiplies a sum of the difference values Diff by a gain value, thereby producing the voltage change signal VCS. In this instance, the gain value multiplied by the difference value Diff is determined based on a data value calculated for measuring and canceling the ripples +Rp and −Rp appearing in the panel 160. Namely, the gain value is determined as a measured value obtained through an experiment.

A digital-to-analog converter (DAC) 132 adjusts the reference voltage Vref output from the reference voltage compensation unit 135 in response to the voltage change signal VCS output from the gain adjusting unit 119. The DAC 132 adjusts and outputs a voltage level between a first reference voltage Vref_H and a second reference voltage Vref_L in response to the voltage change signal VCS.

The reference voltage compensation unit 135 outputs the reference voltage Vref including first to ith positive reverse voltages +VR1 to +VRi or first to ith negative reverse voltages −VR1 to −VRi based on the voltage level output from the DAC 132, where 'i' is an integer equal to or greater than 2.

The timing controller 110 controls a scan driver 120 and a data driver 130 and thus can know an output time point of the reference voltage Vref, in which the ripples +Rp and −Rp are generated. Therefore, when it is estimated that the ripples +Rp and −Rp will be generated in the reference voltage Vref using the difference value calculating unit 117 and the gain adjusting unit 119, the timing controller 110 may indirectly control the reference voltage compensation unit 135 so that the reverse voltages −VR and +VR opposite the ripples +Rp and −Rp are output.

Figure 23:
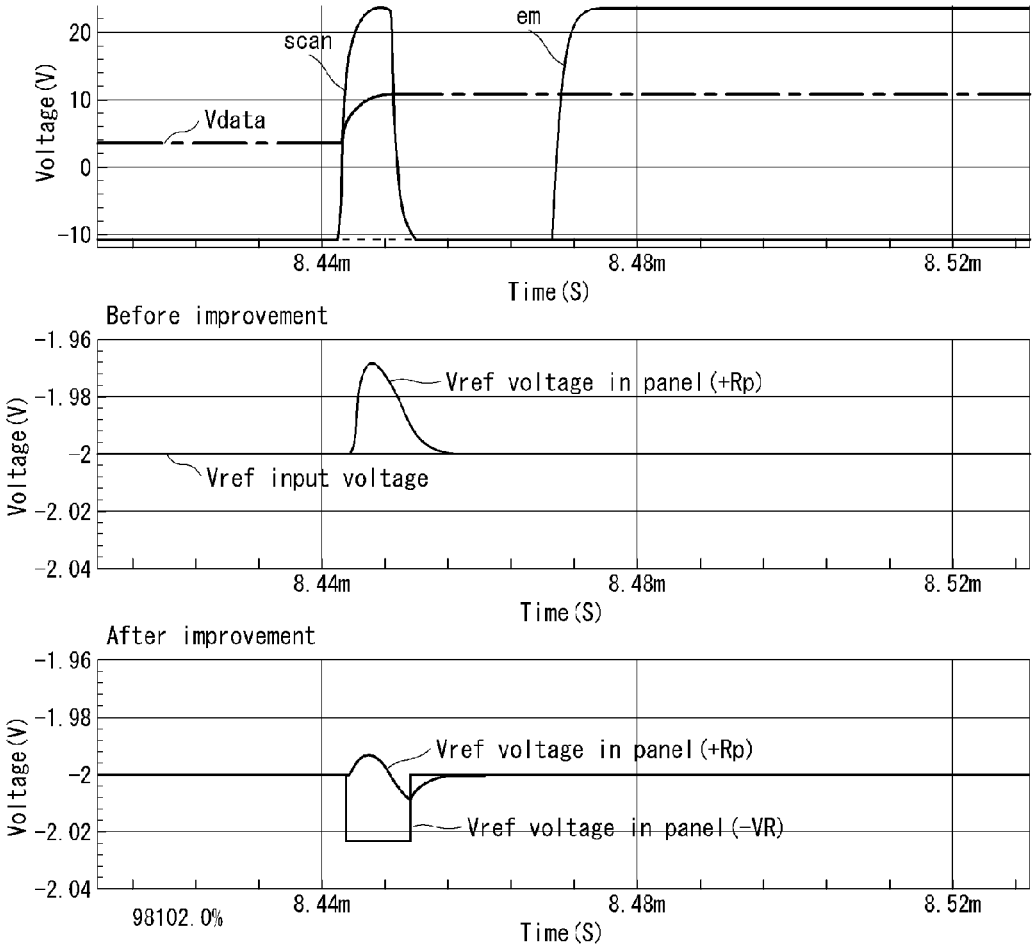
FIG. 23 is a waveform diagram of a simulation result with respect to a method for supplying a reference voltage before the improvement and a method for supplying the reference voltage according to the second embodiment of the invention.
Figure 24:
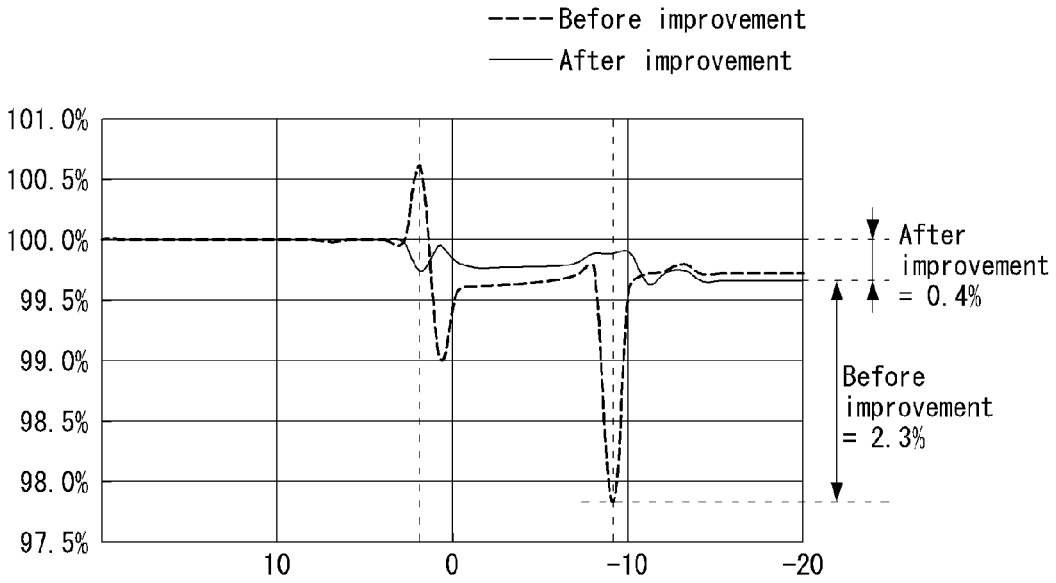
FIG. 24 is a graph for comparing a method for supplying a reference voltage before the improvement with a method for supplying the reference voltage according to the second embodiment of the invention.

FIG. 23 is a waveform diagram of a simulation result with respect to the method for supplying the reference voltage Vref before the improvement and the method for supplying the reference voltage Vref according to the second embodiment of the invention. FIG. 24 is a graph for comparing the method for supplying the reference voltage Vref before the improvement with the method for supplying the reference voltage Vref according to the second embodiment of the invention.

As shown in FIG. 23, the positive ripple +Rp was generated in the reference voltage Vref supplied to the inside of the panel before the improvement. However, in the second embodiment of the invention, it is estimated that the positive ripple +Rp will be generated in the reference voltage Vref, and the positive ripple +Rp generated in the reference voltage Vref is greatly reduced or cancelled by supplying the negative reverse voltage −VR.

As shown in FIG. 24, before the improvement, the current of the subpixel of the panel sloshes with a very large width depending on its position because of the ripples +Rp and −Rp generated in the reference voltage Vref. However, in the second embodiment of the invention, it is estimated that the ripples +Rp and −Rp will be generated in the reference voltage Vref, and the current of the subpixel of the panel sloshes with a small width depending on its position by supplying the reverse voltages +VR and −VR. Thus, the current of the subpixel of the panel sloshed with the width of about 2.3% before the improvement. However, in the second embodiment of the invention, the current of the subpixel of the panel sloshed with the width of about 0.4%. Namely, in the second embodiment of the invention, the ripples were greatly reduced.

A method for driving the organic light emitting display according to the second embodiment of the invention is described below with reference to FIGS. 18 to 24 as well as FIG. 25 for the understanding of the explanation.

Figure 25:
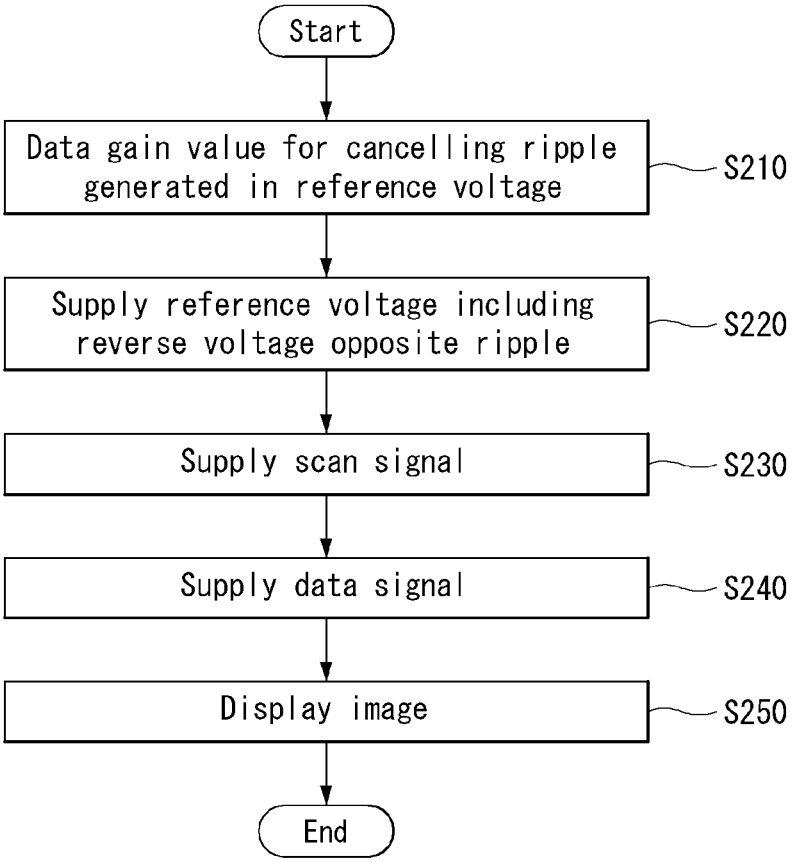
FIG. 25 is a flow chart showing a method for driving an organic light emitting display according to the second embodiment of the invention.

FIG. 25 is a flow chart showing a method for driving the organic light emitting display according to the second embodiment of the invention.

As shown in FIGS. 18 to 25, the method for driving the organic light emitting display according to the second embodiment of the invention may include a step S210 of dating a gain value for cancelling the ripple, a reference voltage supply step S220, a scan signal supply step S230, a data signal supply step S240, and an image display step S250.

The step S210 of dating the gain value for cancelling the ripple is a step of measuring the panel 160 and dating the gain value for cancelling the ripples +Rp and −Rp generated in the reference voltage Vref. The step S210 of dating the gain value for cancelling the ripple compares the (n−1)th data signal with the nth data signal and obtains the difference value Diff corresponding to the current difference, the voltage difference, or the luminance difference, etc. between the images or the patterns displayed on the panel 160. The step S210 of dating the gain value for cancelling the ripple multiplies a sum of the difference values Diff by the gain value obtained through the measurement and obtains the reference voltage Vref including the reverse voltages −VR and +VR for cancelling the ripples +Rp and −Rp generated in the reference voltage Vref based on the multiplication value. Hence, the reference voltage Vref including the first to ith positive reverse voltages +VR1 to +VRi or the first to ith negative reverse voltages −VR1 to −VRi is output, where 'i' is an integer equal to or greater than 2.

The reference voltage supply step S220 is a step of supplying the reference voltage Vref including the reverse voltages −VR and +VR opposite the ripples +Rp and −Rp using the gain value for cancelling the ripples +Rp and −Rp generated in the reference voltage Vref to the subpixels SP of the panel 160.

The scan signal supply step S230 is a step of supplying the scan signal through scan lines SL1 to SLm connected to the subpixels SP included in the panel 160. One scan line includes first to third scan lines EM, INIT, and SCAN. Thus, the fact that the supply of the scan signal to one scan line indicates the supply of an emission control signal 'em', an initialization signal 'init', and a switching signal 'scan' through the first to third scan lines EM, INIT, and SCAN. In the embodiment of the invention, the priority order of the emission control signal 'em' and the initialization signal 'init' supplied through the first and second scan lines EM and INIT is earlier than the priority order of the switching signal 'scan' supplied through the third scan line SCAN as an example. However, the polarity order of the signals may change depending on the configuration of the circuit.

The data signal supply step S240 is a step of supplying a data signal DATA through a data line DL1 connected to the subpixels SP included in the panel 160.

The image display step S250 is a step in which the subpixels SP included in the panel 160 emit light and display the image.

The method illustrated in FIG. 25 briefly described that the reference voltage Vref including the reverse voltages −VR and +VR opposite the ripples +Rp and −Rp using the gain value for cancelling the ripples +Rp and −Rp generated in the reference voltage Vref was supplied to the subpixels SP of the panel 160. However, the method for driving the organic light emitting display according to the embodiment of the invention should be comprehended as the method described throughout FIGS. 18 to 24.

The second embodiment of the invention provides the organic light emitting display and the method for driving the same capable of preventing the horizontal crosstalk from being generated in the panel when the compensation circuit is used in each subpixel and a specific pattern is displayed. Further, the second embodiment of the invention provides the organic light emitting display and the method for driving the same capable of preventing the horizontal crosstalk from being generated in the panel by measuring the ripple of the reference voltage appearing in the panel and varying the reference voltage based on the measured ripple.

Third Embodiment

Figure 26:
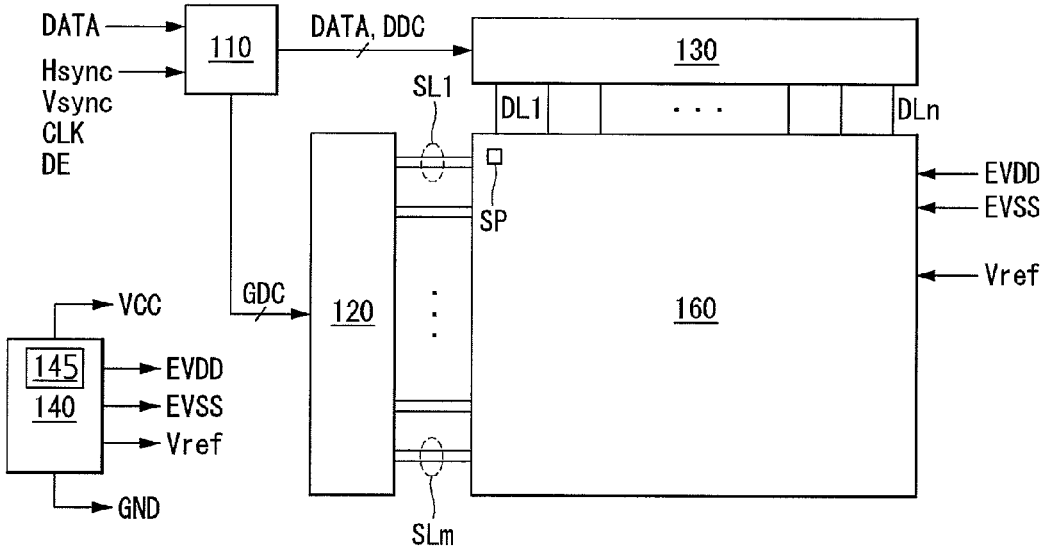
FIG. 26 schematically shows a configuration of an organic light emitting display according to a third embodiment of the invention.
Figure 27:
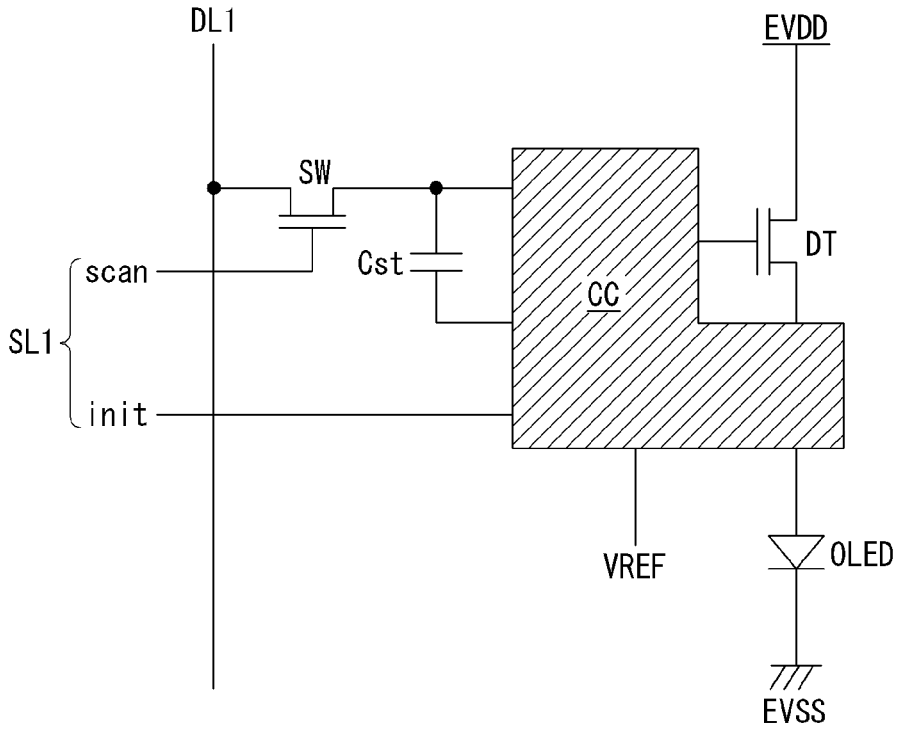
FIG. 27 shows a circuit configuration of a subpixel.
Figure 28:
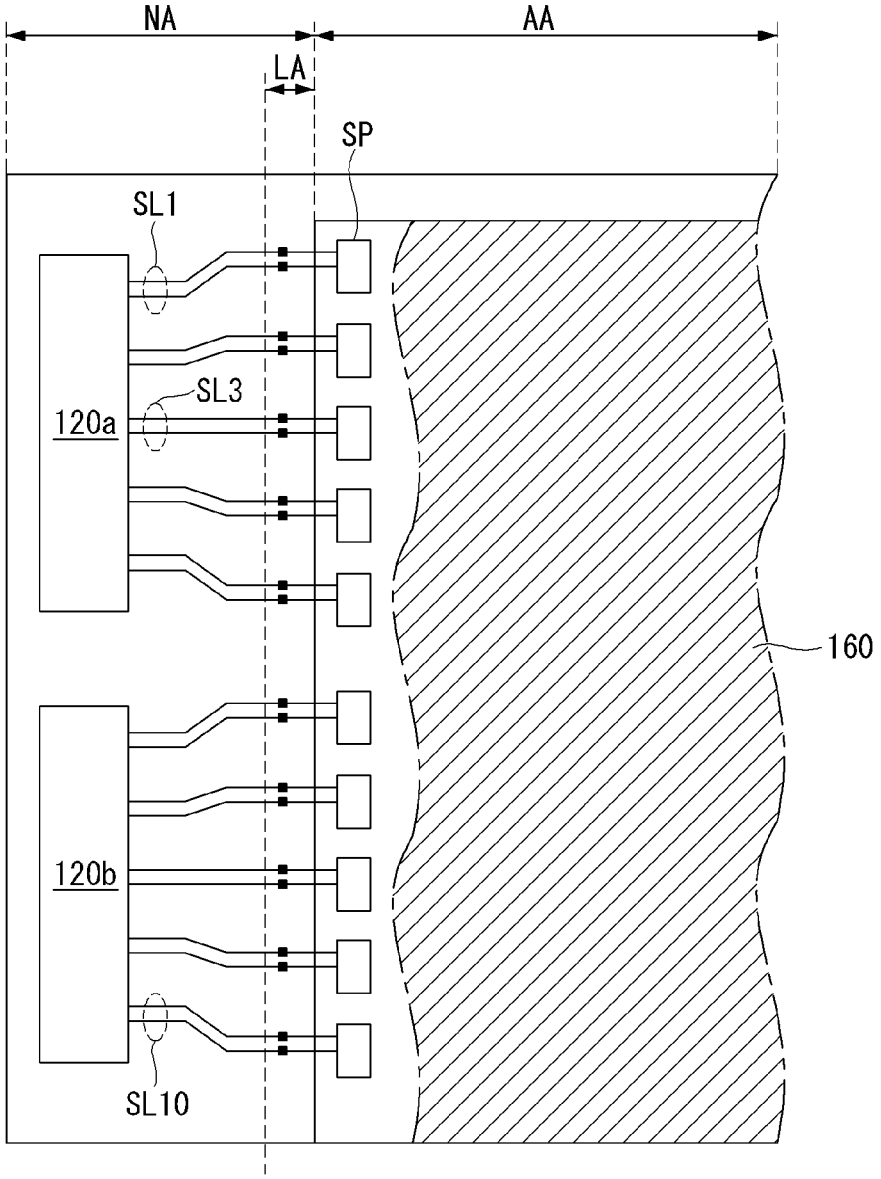
FIG. 28 shows a layout of scan lines of a panel including a subpixel shown in FIG. 27.
Figure 29:
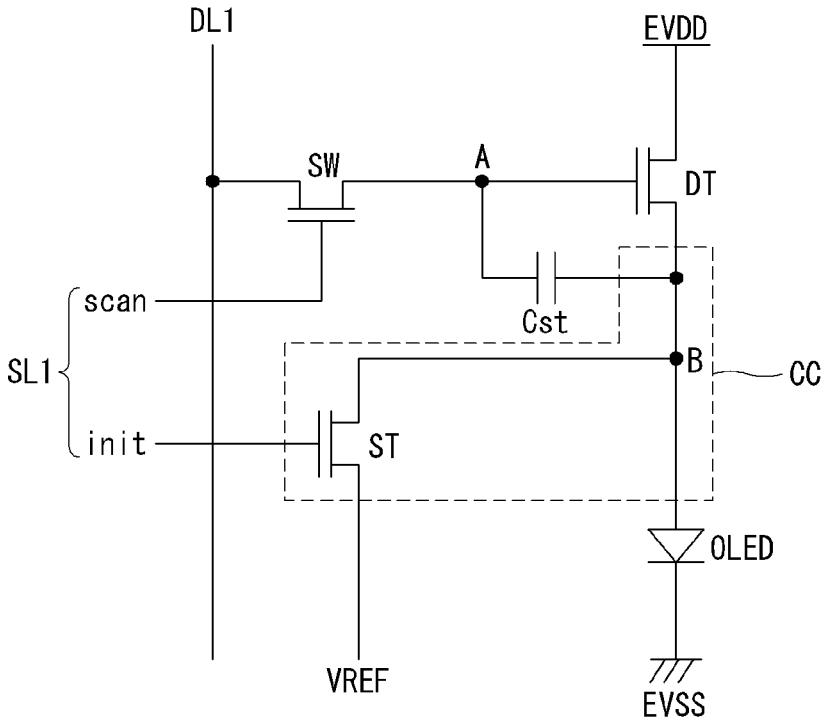
FIG. 29 shows an exemplary configuration of a compensation circuit shown in FIG. 27.
Figure 30:
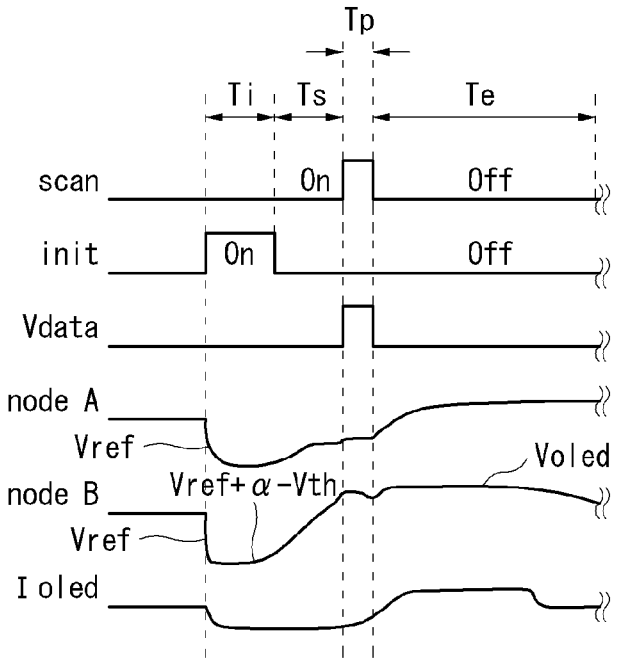
FIG. 30 is a driving waveform diagram of a subpixel shown in FIG. 29.

FIG. 26 schematically shows a configuration of an organic light emitting display according to a third embodiment of the invention. FIG. 27 shows a circuit configuration of a subpixel. FIG. 28 shows a layout of scan lines of a panel including a subpixel shown in FIG. 27. FIG. 29 shows an exemplary configuration of a compensation circuit shown in FIG. 27. FIG. 30 is a driving waveform diagram of a subpixel shown in FIG. 29.

As shown in FIG. 26, the organic light emitting display according to the third embodiment of the invention includes a timing controller 110, a data driver 130, a scan driver 120, a panel 160, and a power supply unit 140.

The power supply unit 140 converts a voltage supplied from the outside and may output a first high potential power voltage, a second high potential power voltage, a first low potential power voltage, and a second low potential power voltage. The first high potential power voltage and the first low potential power voltage are respectively output through a first power supply line EVDD and a first ground line EVSS, and the second high potential power voltage and the second low potential power voltage are respectively output through a second power supply line VCC and a second ground line GND.

The first and second embodiments described that the data driver 130 includes a component outputting the reference voltage Vref. However, the configuration of the first and second embodiments is merely an example. For example, as shown in FIG. 26, the reference voltage Vref may be output from the power supply unit 140. In this instance, the power supply unit 140 may directly output the reference voltage Vref based on a register value stored in a register 145. Alternatively, the data driver 130 may output the reference voltage Vref based on a voltage level output based on the register value stored in the register 145. Namely, the component outputting the reference voltage Vref may be variously changed.

As shown in FIG. 27, each subpixel SP may include a compensation circuit CC. When the subpixel SP includes the compensation circuit CC as shown in FIG. 27 and the scan driver 120 is formed in a gate-in panel (GIP) manner, a layout of the scan lines may be formed as shown in FIG. 28. Namely, the scan driver 120 may be formed in a structure similar to FIG. 5. However, in the third embodiment of the invention, one scan line SL1 includes first and second scan lines INIT and SCAN.

As shown in FIG. 29, the compensation circuit CC includes a reference voltage supply transistor ST. The reference voltage supply transistor ST supplies the reference voltage Vref to a node B in response to an initialization signal 'inn' supplied through the first scan line INIT. A gate electrode of the reference voltage supply transistor ST is connected to the first scan line INIT, a first electrode of the reference voltage supply transistor ST is connected to the node B, and a second electrode of the reference voltage supply transistor ST is connected to a reference voltage line VREF.

Because the compensation circuit CC is configured as described above, a switching transistor SW supplies a data voltage Vdata to a node A in response to a switching signal 'scan' supplied through the second scan line SCAN. A gate electrode of the switching transistor SW is connected to the second scan line SCAN, a first electrode of the switching transistor SW is connected to the node A, and a second electrode of the switching transistor SW is connected to the first data line DL1. One terminal of a storage capacitor Cst is connected to the node A, and the other terminal is connected to the node B. A gate electrode of a driving transistor DT is connected to the node A, a first electrode of the driving transistor DT is connected to the node B, and a second electrode of the driving transistor DT is connected to the first power supply line EVDD. An anode electrode of an organic light emitting diode OLED is connected to the node B, and a cathode electrode of the organic light emitting diode OLED is connected to the first ground line EVSS. In the above description, the embodiment of the invention selects the first electrode of the transistor as a source electrode and selects the second electrode of the transistor as a drain electrode as an example, but is not limited thereto.

As shown in FIG. 30, the subpixel including the compensation circuit CC may be divided into an initialization period Ti in which the node B is initialized to a specific voltage, a sensing period Ts in which a threshold voltage of the driving transistor DT is detected and stored, a programming period Tp in which the data voltage Vdata is applied, and an emission period Te in which a driving current applied to the organic light emitting diode OLED is compensated using the threshold voltage and the data voltage Vdata irrespective of the threshold voltage. The embodiment of the invention is not limited thereto.

The first and second embodiments described that each of scan lines SL1 to SLm of the subpixels SP includes the three scan lines. However, the configuration of the first and second embodiments is merely an example. For example, as shown in FIG. 27, each scan line may include the two scan lines SCAN and INIT.

In the third embodiment, a color difference is generated in the panels each including the compensation circuits when a specific pattern is implemented in the same manner as the first and second embodiments.

Figure 31:
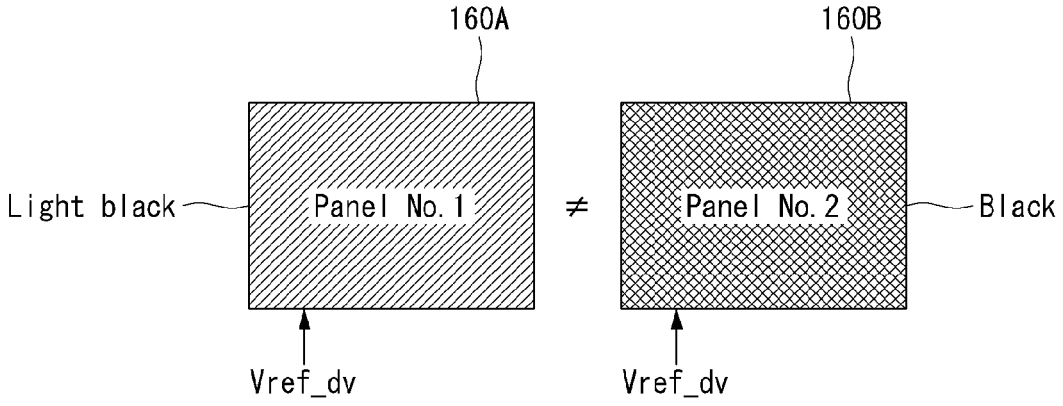
FIGS. 31 and 32 are diagrams for explaining the generation of a color difference between panels.
Figure 32:
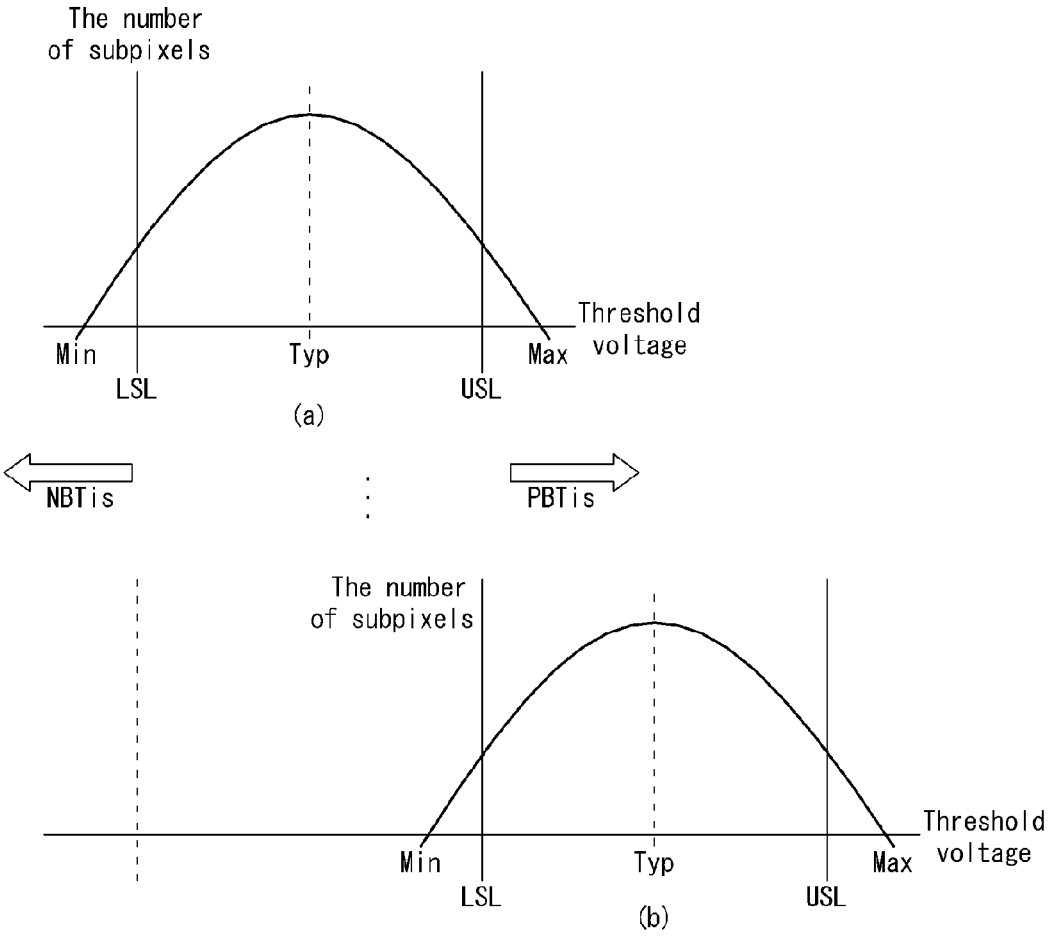

FIGS. 31 and 32 are diagrams for explaining the generation of a color difference between panels.

As shown in FIG. 31, even if two panels 160A and 160B are manufactured under the same condition, the first panel 160A may display a light black and the second panel 160B may display a black when a specific pattern is implemented. This is because of a difference between threshold voltage characteristics of driving transistors of the panels.

For example, a threshold voltage Vth of a driving transistor included in each of subpixels of the first panel 160A is measured and indicated by a graph shown in (a) of FIG. 32, and a threshold voltage Vth of a driving transistor included in each subpixel of the second panel 160B is measured and indicated by a graph shown in (b) of FIG. 32. In FIG. 32, (a) shows that the threshold voltage Vth of the driving transistor is inclined to a direction of a negative bias NBTiS, and (b) shows that the threshold voltage Vth of the driving transistor is inclined to a direction of a positive bias PBTiS.

FIG. 32 is a graph showing the distribution of the threshold voltages of the driving transistor depending on the number of subpixels. FIG. 32 shows only two graphs as an example, but very many types of graphs are substantially present between (a) and (b) of FIG. 32. The graphs present between (a) and (b) of FIG. 32 may include graphs having the same condition, or may include graphs having the different conditions. Namely, even if the panels are manufactured under the same condition, the threshold voltage characteristics of the driving transistors of the panels may be different from one another depending on lot-to-lot, slot-to-slot, and cell-to-cell.

Therefore, when a default reference voltage Vref_dv of the same driving condition is applied to the panel including the compensation circuit, the first panel 160A represents the light black, and the second panel 160B represents the black as shown in FIG. 31.

As described above, because the threshold voltage characteristics of the panels are different from one another, the organic light emitting display according to the third embodiment of the invention is manufactured as follows so as to improve the difference.

Figure 33:
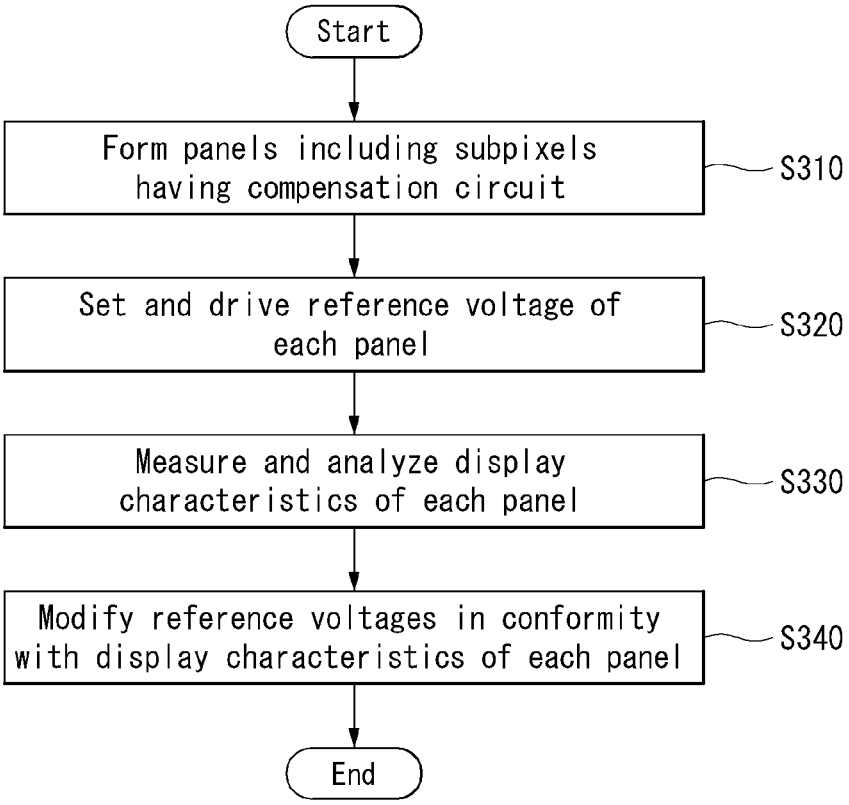
FIG. 33 is a flow chart showing a method for manufacturing an organic light emitting display according to the third embodiment of the invention.
Figure 34:
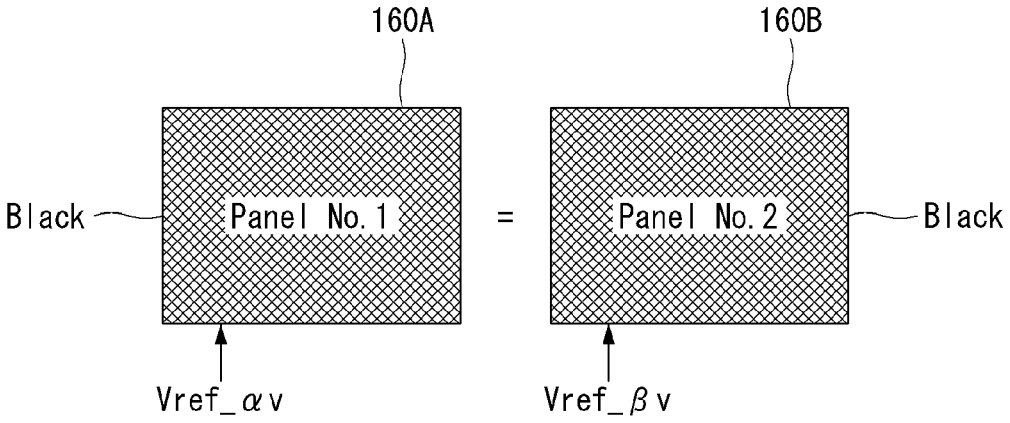
FIG. 34 shows an example where the generation problem of a color difference between panels is improved according to the third embodiment of the invention.

FIG. 33 is a flow chart showing a method for manufacturing the organic light emitting display according to the third embodiment of the invention. FIG. 34 shows an example where the generation problem of the color difference between the panels is improved according to the third embodiment of the invention.

As shown in FIG. 33, a method for manufacturing the organic light emitting display according to the third embodiment of the invention may include a step S310 of forming panels, a step S320 of setting the reference voltage and driving the panels, a step S330 of measuring and analyzing display characteristics of each panel, and a step S340 of differently modifying the reference voltages of the panels based on the display characteristics of each panel.

The step S310 of forming the panels is a step of forming the panels including the subpixels each including the compensation circuit including the reference voltage supply transistor. The subpixels including the reference voltage supply transistors may be configured as shown in FIG. 3 or FIG. 29, but are not limited thereto. When the embodiment of the invention is applied to the subpixels configured as shown in FIG. 3 or FIG. 29, the generation problem of the color difference between the panels can be solved.

The step S320 of setting the reference voltage and driving the panels is a step of setting a default reference voltage of each panel and driving the panels. When the default reference voltage of each panel is set and driven, the panels displays at least one of a light black, a black, and a dark black depending on the threshold voltage characteristics of the driving transistor of the subpixel. In this instance, values set as the default reference voltage are stored in the register 145 included in the power supply unit 140 shown in FIG. 26.

The step S330 of measuring and analyzing the display characteristics of each panel is a step of measuring and analyzing the display characteristics of each panel. Because the same default reference voltage is set in the panels, the threshold voltage characteristics of the driving transistors of the subpixels of each panel can be known. As shown in FIG. 32, when the threshold voltages of the driving transistors are measured and analyzed, the threshold voltages are distributed between a minimum value Min and a maximum value Max based on an average value Typ. Further, when the threshold voltages of the driving transistors are measured and analyzed, the generation problem of the color difference between the panels may be reduced based on a change amount of the reference voltage. For example, the generation problem of the color difference between the panels may be reduced by defining two standard values LSL and USL in the distributed threshold voltages and adjusting the reference voltage in conformity with one of the standard values LSL and USL. Namely, the two standard values LSL and USL are a criterion of an adjustment value used to adjust the reference voltage.

The step S340 of differently modifying the reference voltages of the panels based on the display characteristics of each panel is a step of differently modifying the reference voltage of the first panel 160A and the reference voltage of the second panel 160B based on the adjustment value obtained in the step S330 of measuring and analyzing the display characteristics of each panel. For example, when the distribution of the threshold voltages in the first panel 160A is different from the distribution of the threshold voltages in the second panel 160B, the reference voltages set in the two panels 160A and 160B are different from each other. On the other hand, when the distribution of the threshold voltages in the first panel 160A is the same as the distribution of the threshold voltages in the second panel 160B, the reference voltages set in the two panels 160A and 160B are the same. However, strictly speaking, because it is improbable that the distribution of the threshold voltages in the first panel 160A is the same as the distribution of the threshold voltages in the second panel 160B, the reference voltages set in the two panels 160A and 160B are different from each other.

As shown in FIG. 34, the distribution of the threshold voltages in the first panel 160A is different from the distribution of the threshold voltages in the second panel 160B according to the above-described method. Thus, a first correction reference voltage Vref_αV is set in the register 145 included in the power supply unit 140 of the first panel 160A. On the other hand, a second correction reference voltage Vref_βV is set in the register 145 included in the power supply unit 140 of the second panel 160B.

The third embodiment of the invention provides the method for manufacturing the organic light emitting display capable of preventing the color difference from being generated between the panels when the compensation circuit is used in each subpixel and a specific pattern is displayed. Further, the third embodiment of the invention provides the method for manufacturing the organic light emitting display capable of preventing the color difference from being generated between the panels by modifying the reference voltage based on the threshold voltage characteristics of each panel.

The first to third embodiments of the invention were dividedly described based on the structure, the configuration, and the effect. However, the first to third embodiments of the invention may be combined so as to optimize the panel including the subpixels having the compensation circuits. For example, the embodiment of the invention may combine the first and second embodiments of the invention, thereby varying the reference voltage on each scan line, and at the same time, causing the reference voltage to include the reverse voltage for removing the ripple. Further, the embodiment of the invention may combine the first and third embodiments of the invention, thereby setting the registers so that the panels output the different reference voltages, and at the same time, varying the reference voltage on each scan line. Further, the embodiment of the invention may combine the second and third embodiments of the invention, thereby setting the registers so that the panels output the different reference voltages, and at the same time, causing the reference voltage to include the reverse voltage for removing the ripple.

As described above, the embodiment of the invention provides the organic light emitting display, the method for driving the same, and the method for manufacturing the same capable of solving the various problems (for example, the luminance spot, the horizontal crosstalk, the threshold voltage deviation, etc.) generated when the compensation circuit is used in each subpixel and the specific pattern is displayed.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising: a panel including subpixels each having a compensation circuit including a reference voltage supply transistor, which receives a reference voltage and initializes a node of a gate electrode or a drain electrode of a driving transistor using the reference voltage; a scan driver configured to supply a scan signal to scan lines of the panel; a data driver configured to supply a data signal to data lines of the panel; a timing controller configured to control the scan driver and the data driver; and a reference voltage compensation unit configured to vary the reference voltage on each scan line and supply the reference voltage to the subpixels; wherein the reference voltage compensation unit supplies the reference voltage to the subpixels so that the reference voltage has a voltage deviation of the same interval, and compensates for a luminance spot of a transverse direction appearing on each scan line.

2. The organic light emitting display of claim 1, wherein the reference voltage compensation unit varies the reference voltage every at least one scan line and supplies the reference voltage to the subpixels.

3. The organic light emitting display of claim 1, wherein the reference voltage compensation unit divides a first voltage and a second voltage output from a digital-to-analog converter included in the data driver and produces the reference voltage.

4. The organic light emitting display of claim 3, wherein the reference voltage compensation unit varies the reference voltage based on a variation value of the second voltage.

5. The organic light emitting display of claim 1, wherein the reference voltage compensation unit includes:

a first resistor having one terminal connected to a first voltage terminal;

an operational amplifier having a non-inverting terminal connected to the other terminal of the first resistor and an inverting terminal connected to an output terminal of the operational amplifier; and a second resistor having one terminal connected to the non-inverting terminal of the operational amplifier and the other terminal connected to a second voltage terminal.

6. The organic light emitting display of claim 3, wherein the timing controller supplies a voltage change signal which changes the second voltage output from the digital-to-analog converter through the communication with the data driver.

7. The organic light emitting display of claim 6, wherein the timing controller includes:

a lookup table configured to record information about a luminance spot of a transverse direction appearing on each scan line;

a memory configured to store the voltage change signal corresponding to the information about the luminance spot of the transverse direction; and a data processing unit configured to decide a time point at which the reference voltage is supplied to each scan line, analyze the information about the luminance spot of the transverse direction appearing on each scan line through the lookup table, and output the voltage change signal corresponding to the information about the luminance spot of the transverse direction through the memory.

8. The organic light emitting display of claim 7, wherein the information about the luminance spot of the transverse direction appearing on each scan line is recorded based on a luminance map measuring a luminance of the panel.

9. A method for driving an organic light emitting display comprising: supplying a reference voltage to subpixels included in a panel; supplying a scan signal to the subpixels included in the panel; and supplying a data signal to the subpixels included in the panel, wherein the supplying of the reference voltage includes varying the reference voltage on each scan line of the panel; wherein the supplying of the reference voltage includes supplying the reference voltage to the subpixels so that the reference voltage has a voltage deviation of the same interval, and compensating for a luminance spot of a transverse direction appearing on each scan line.

10. The method of claim 9, wherein the supplying of the reference voltage includes varying the reference voltage every at least one scan line and supplying the reference voltage to the subpixels.

* * * * *